US011642753B2

(12) United States Patent
Nomura et al.

(10) Patent No.: US 11,642,753 B2
(45) Date of Patent: May 9, 2023

(54) POLISHING-PAD LAMINATED STRUCTURE, POLISHING-PAD POSITIONING INSTRUMENT, AND METHOD OF ATTACHING A POLISHING PAD TO A POLISHING TABLE

(71) Applicant: EBARA CORPORATION, Tokyo (JP)

(72) Inventors: Toshikazu Nomura, Tokyo (JP); Masaki Kinoshita, Tokyo (JP); Nobuyuki Takahashi, Tokyo (JP); Suguru Sakugawa, Tokyo (JP); Takashi Kishi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 1014 days.

(21) Appl. No.: 16/426,398

(22) Filed: May 30, 2019

(65) Prior Publication Data

US 2020/0023489 A1 Jan. 23, 2020

Related U.S. Application Data

(60) Provisional application No. 62/691,119, filed on Jun. 28, 2018.

(51) Int. Cl.

| | |
|---|---|
| ***B24B 47/22*** | (2006.01) |
| ***B24B 37/005*** | (2012.01) |
| ***B24B 37/34*** | (2012.01) |
| ***B24B 37/26*** | (2012.01) |

(52) U.S. Cl.

CPC ..... *B24B 47/22* (2013.01); *B24B 37/005* (2013.01); *B24B 37/26* (2013.01); *B24B 37/345* (2013.01)

(58) Field of Classification Search

CPC ..... B24B 37/11; B24B 37/20; B24B 37/205; B24B 37/22; B24B 37/24; B24B 37/26

See application file for complete search history.

(56) References Cited

U.S. PATENT DOCUMENTS

| | | | | |
|---|---|---|---|---|
| 6,179,950 | B1 | 1/2001 | Zhang et al. | |
| 8,992,288 | B2 * | 3/2015 | Suzuki | B24B 37/22 451/285 |
| 2002/0081958 | A1 | 6/2002 | Foster | |
| 2003/0114079 | A1 * | 6/2003 | Berkstresser | B24B 37/12 451/28 |
| 2007/0010169 | A1 * | 1/2007 | Swisher | B24B 37/205 451/526 |

(Continued)

FOREIGN PATENT DOCUMENTS

| | | | | |
|---|---|---|---|---|
| EP | 2204259 | A2 * | 7/2010 | B24B 13/005 |
| JP | H11-309641 | A | 11/1999 | |

(Continued)

*Primary Examiner* — Joel D Crandall

(74) *Attorney, Agent, or Firm* — BakerHostetler

(57) ABSTRACT

A polishing-pad laminated structure which allows for easy alignment of a through-hole of a polishing pad with a sensor head installed in a polishing table is disclosed. The polishing-pad laminated structure includes a polishing pad and a release sheet. The polishing pad has a through-hole located at a position corresponding to a position of a sensor head disposed in the polishing table. The release sheet covers an adhesive surface of the polishing pad. The release sheet is divided into at least a first release sheet and a second release sheet. The first release sheet has a surface area smaller than a surface area of the second release sheet.

11 Claims, 40 Drawing Sheets

(56) References Cited

U.S. PATENT DOCUMENTS

| | | | | |
|---|---|---|---|---|
| 2008/0305729 | A1* | 12/2008 | Benvegnu | B24B 37/013 264/263 |
| 2009/0124176 | A1* | 5/2009 | Borucki | B24B 37/20 451/286 |
| 2011/0281510 | A1* | 11/2011 | Swedek | B24B 37/26 51/296 |

FOREIGN PATENT DOCUMENTS

| | | | | |
|---|---|---|---|---|
| JP | 2004-090106 | A | 3/2004 | |
| JP | 2005-230981 | A | 9/2005 | |
| JP | 2009-119592 | A | 6/2009 | |
| JP | 2015-009340 | A | 1/2015 | |
| JP | 2016-117108 | A | 6/2016 | |
| WO | WO-2004101223 | A1 * | 11/2004 | B24B 37/013 |
| WO | WO 2011/142975 | A3 | 11/2011 | |

* cited by examiner

POLISHING-PAD LAMINATED STRUCTURE, POLISHING-PAD POSITIONING INSTRUMENT, AND METHOD OF ATTACHING A POLISHING PAD TO A POLISHING TABLE

BACKGROUND

Manufacturing processes of semiconductor devices include a process of polishing a dielectric film, e.g., $SiO_2$, and a process of polishing a metal film, e.g., copper or tungsten. Manufacturing processes of backside illumination CMOS sensor and through-silicon via (TSV) include a process of polishing a silicon layer (silicon wafer), in addition to the polishing processes of the dielectric film and the metal film.

Wafer polishing is generally performed using a chemical mechanical polishing apparatus (or a CMP apparatus). This CMP apparatus is configured to polish a surface of the wafer by bringing the wafer into sliding contact with a polishing pad attached to a polishing table while supplying slurry onto the polishing pad. The polishing of the wafer is terminated when a thickness of a film (an insulating film, a metal film, a silicon layer, etc.), constituting the surface of the wafer, reaches a predetermined target value. Therefore, the film thickness is measured during polishing of the wafer.

An optical film-thickness measuring device is one example of a film-thickness measuring device. The optical film-thickness measuring device is configured to direct light to a surface of a wafer and analyze optical information contained in reflected light from the wafer to thereby measure a film thickness. The optical film-thickness measuring device includes a sensor head including a light emitter and a light receiver disposed in the polishing table. The polishing pad has a through-hole at the same position as the position of the sensor head. The light emitted from the sensor head is directed to the wafer through the through-hole of the polishing pad, and the reflected light from the wafer passes through the through-hole again to reach the sensor head.

The polishing pad wears gradually as polishing of wafers and dressing of the polishing pad are repeated. Therefore, if the wear of the polishing pad has progressed to some extent, it is replaced with a new polishing pad. A back surface of the polishing pad is composed of an adhesive surface, and the polishing pad is attached to the top surface of the polishing table. When attaching the polishing pad to the polishing table, it is important to accurately align the through-hole of the polishing pad with the sensor head disposed in the polishing table. This is because, if the through-hole of the polishing pad is not in alignment with the sensor head, the film-thickness measuring accuracy is lowered.

However, it is difficult to accurately align the through-hole of the polishing pad with the sensor head disposed in the polishing table. In particular, since the through-hole of the polishing pad are typically small, it takes a long time to properly attach the polishing pad to the polishing table, thus resulting in a decrease in operation rate of the polishing apparatus.

SUMMARY OF THE INVENTION

Therefore, according to one embodiment, there are provided a polishing-pad laminated structure and a polishing-pad positioning instrument which allow for easy alignment of a through-hole of a polishing pad with a sensor head installed in a polishing table. Further, according to one embodiment, there is provided a method of attaching a polishing pad to a polishing table using the polishing-pad positioning instrument.

The below-described embodiments relate to a polishing pad used in a polishing apparatus for polishing a substrate such as a wafer, and in particular, a polishing pad used in a polishing apparatus provided with a polishing table in which a film-thickness measuring device is disposed.

In an embodiment, there is provided a polishing-pad laminated structure comprising: a polishing pad having a through-hole located at a position corresponding to a position of a sensor head disposed in a polishing table; and a release sheet covering an adhesive surface of the polishing pad, the release sheet being divided into at least a first release sheet and a second release sheet, the first release sheet having a surface area smaller than a surface area of the second release sheet.

In an embodiment, the second release sheet has a through-hole at a same position as a position of the through-hole of the polishing pad.

In an embodiment, the polishing-pad laminated structure further comprises a release assisting projection connected to an edge of the second release sheet.

In an embodiment, there is provided a polishing-pad positioning instrument for positioning a polishing pad with respect to a polishing table, comprising: a positioning structure configured to be removably attached to the polishing table, the positioning structure including (i) a first positioning protrusion configured to be inserted into a table hole formed in a pad support surface of the polishing table, and (ii) a second positioning protrusion fixed to the first positioning protrusion, the second positioning protrusion having a cross-sectional shape corresponding to a cross-sectional shape of a through-hole formed in the polishing pad.

In an embodiment, a length of the second positioning protrusion along a central axis of the second positioning protrusion is not less than a thickness of the polishing pad.

In an embodiment, the polishing-pad positioning instrument further comprises a support structure supporting the second positioning protrusion, the support structure having a bottom surface perpendicular to a central axis of the second positioning protrusion.

In an embodiment, the second positioning protrusion is supported by the support structure such that the second positioning protrusion is movable along the central axis of the second positioning protrusion.

In an embodiment, the polishing-pad positioning instrument further comprises a spring disposed between the second positioning protrusion and the support structure, the positioning structure being forced by the spring in an extending direction of the central axis of the second positioning protrusion.

In an embodiment, there is provided a method of attaching a polishing pad to a pad support surface of a polishing table, comprising: (i) providing a polishing-pad laminated structure including the polishing pad and a release sheet, the polishing pad having a through-hole located at a position corresponding to a position of a sensor head disposed in the polishing table, the release sheet covering an adhesive surface of the polishing pad, the release sheet being divided into at least a first release sheet and a second release sheet, the first release sheet having a surface area smaller than a surface area of the second release sheet; (ii) providing a positioning structure including a first positioning protrusion and a second positioning protrusion, the first positioning protrusion being configured to be inserted into a table hole formed in the pad support surface of the polishing table, the second positioning protrusion being fixed to the first positioning protrusion, the second positioning protrusion having a cross-sectional shape corresponding to a cross-sectional shape of the through-hole of the polishing pad; (iii) placing the polishing-pad laminated structure, from which the first release sheet has been removed, on the pad support surface of the polishing table; (iv) inserting the first positioning protrusion into the table hole through the through-hole of the polishing pad; (v) inserting the second positioning protrusion into the through-hole of the polishing pad; (vi) removing the positioning structure from the polishing table and the polishing pad; and (vii) removing the second release sheet from the polishing pad and attaching the entire adhesive surface of the polishing pad to the pad support surface of the polishing table.

In an embodiment, there is provided a method of attaching a polishing pad to a pad support surface of a polishing table, comprising: (i) providing a polishing-pad laminated structure including the polishing pad and a release sheet, the polishing pad having a through-hole located at a position corresponding to a position of a sensor head disposed in the polishing table, the release sheet covering an adhesive surface of the polishing pad, the release sheet being divided into at least a first release sheet and a second release sheet, the first release sheet having a surface area smaller than a surface area of the second release sheet; (ii) providing a positioning structure including a first positioning protrusion and a second positioning protrusion, the first positioning protrusion being configured to be inserted into a table hole formed in the pad support surface of the polishing table, the second positioning protrusion being fixed to the first positioning protrusion, the second positioning protrusion having a cross-sectional shape corresponding to a cross-sectional shape of the through-hole of the polishing pad; (iii) inserting the first positioning protrusion into the table hole; (iv) placing the polishing-pad laminated structure, from which the first release sheet has been removed, on the pad support surface of the polishing table; (v) inserting the second positioning protrusion into the through-hole of the polishing pad; (vi) removing the positioning structure from the polishing table and the polishing pad; and (vii) removing the second release sheet from the polishing pad and attaching the entire adhesive surface of the polishing pad to the pad support surface of the polishing table.

According to the embodiments described above, the position of the polishing pad with respect to the polishing table is adjusted in a state where the first release sheet having a small surface area has been removed. Since the polishing-pad laminated structure can be moved relatively freely on the polishing table, the through-hole of the polishing pad can be precisely aligned with the sensor head disposed in the polishing table. Further, immediately after the alignment of the through-hole of the polishing pad with the sensor head is completed, the exposed portion of the adhesive surface of the polishing pad (i.e., the portion that has been covered with the first release sheet) is pressed against the polishing table, so that the relative position of the polishing pad with respect to the polishing table can be fixed.

Furthermore, according to the above-described embodiments, the positioning of the polishing pad with respect to the polishing table is completed by inserting the second positioning protrusion of the positioning structure into the through-hole of the polishing pad. Accordingly, the attachment work of the polishing pad can be easy.

DESCRIPTION OF EMBODIMENTS

Figure 1:
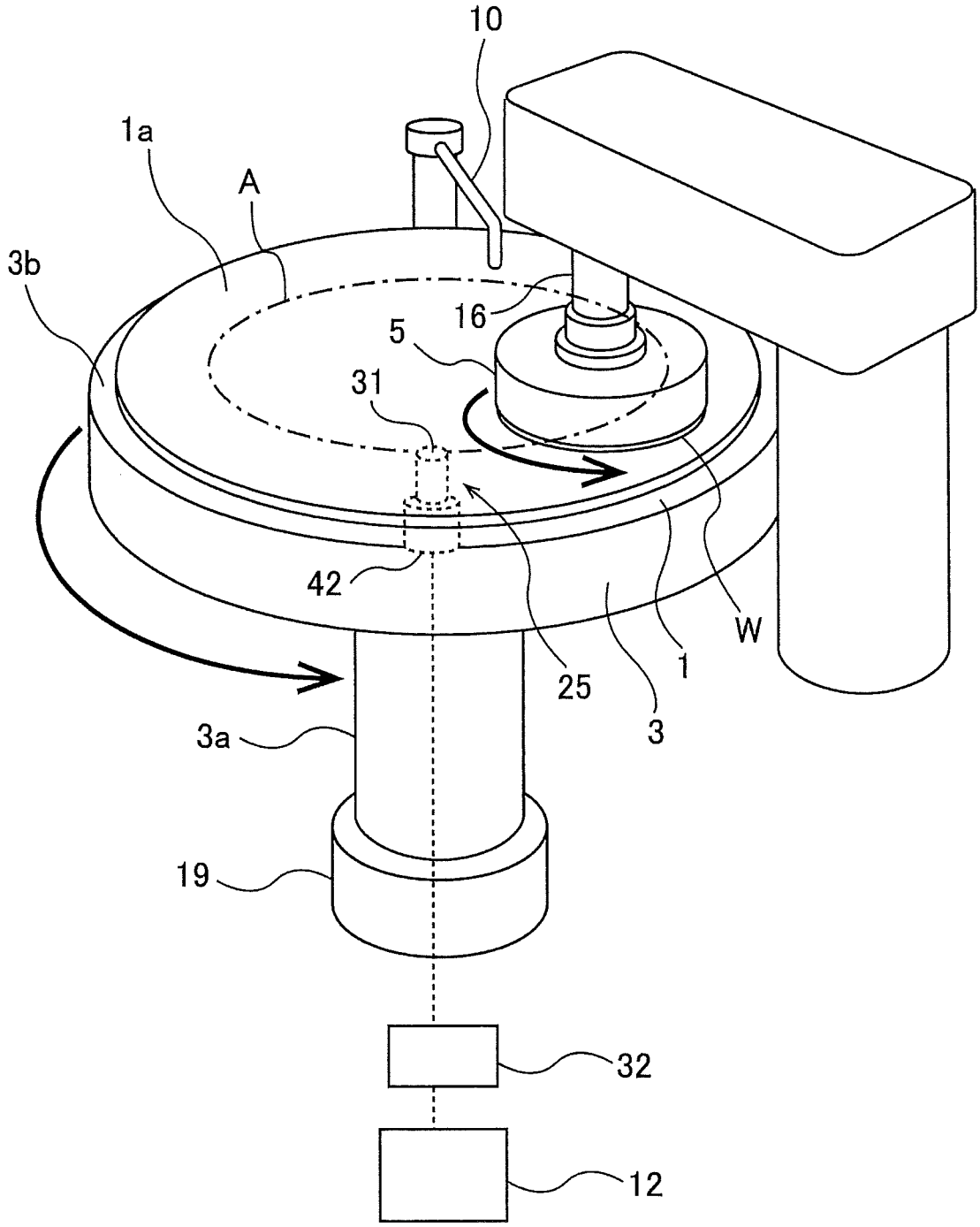
FIG. 1 is a view showing an embodiment of a polishing apparatus.

Embodiments will be described below with reference to the drawings. FIG. 1 is a view showing an embodiment of a polishing apparatus. As shown in FIG. 1, the polishing apparatus includes a polishing table 3 to which a polishing pad 1 having a polishing surface 1*a* is attached, a polishing head 5 for holding a wafer W, which is an example of a substrate, and pressing the wafer W against the polishing pad 1 on the polishing table 3 to polish the wafer W, a polishing-liquid supply nozzle 10 for supplying a polishing liquid (e.g., slurry) onto the polishing pad 1, and a polishing controller 12 for controlling polishing of the wafer W.

The polishing table 3 is coupled to a table motor 19 through a table shaft 3*a*, so that the polishing table 3 is rotated by the table motor 19 in a direction indicated by arrow. The table motor 19 is located below the polishing table 3. The polishing pad 1 is attached to a pad support surface 3*b* of the polishing table 3. The pad support surface 3*b* is composed of an upper surface of the polishing table 3. The polishing pad 1 has an upper surface, which provides a polishing surface 1*a* for polishing the wafer W. The polishing head 5 is secured to a lower end of a polishing head shaft 16. The polishing head 5 is configured to be able to hold the wafer W on its lower surface by vacuum suction. The polishing head shaft 16 can be elevated and lowered by an elevating mechanism (not shown in the drawing).

Polishing of the wafer W is performed as follows. The polishing head 5 and the polishing table 3 are rotated in directions indicated by arrows, while the polishing liquid (or slurry) is supplied from the polishing-liquid supply nozzle 10 onto the polishing pad 1. In this state, the polishing head 5 presses the wafer W against the polishing surface 1*a* of the polishing pad 1. The surface of the wafer W is polished by a mechanical action of abrasive grains contained in the polishing liquid and a chemical action of the polishing liquid.

The polishing apparatus includes an optical film-thickness measuring device (film-thickness measuring apparatus) 25 for measuring a film thickness of the wafer W. This optical film-thickness measuring device 25 has a sensor module 42 for obtaining an optical signal that varies in accordance with the film thickness of the wafer W, and a processor 32 for determining the film thickness from the optical signal. The sensor module 42 is disposed in the polishing table 3, and the processor 32 is coupled to the polishing controller 12. The sensor module 42 includes a sensor head 31 configured to direct light to the surface of the wafer W and receive reflected light from the wafer W. The sensor head 31 rotates together with the polishing table 3 as indicated by arrow A, and obtains the optical signal of the wafer W held on the polishing head 5. The sensor module 42 is coupled to the processor 32 so that the optical signal, obtained by the sensor module 42, is sent to the processor 32.

Figure 2:
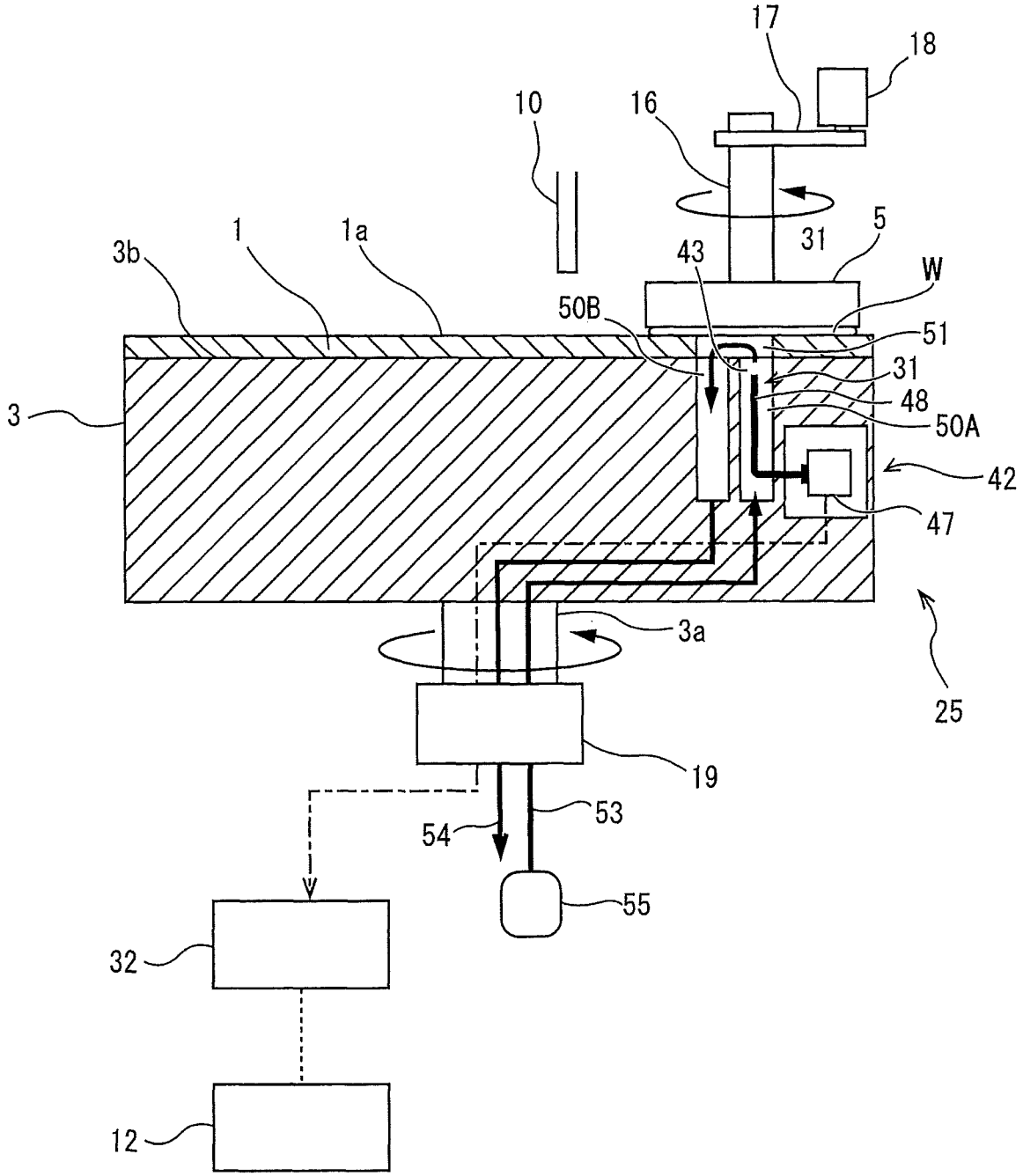
FIG. 2 is a schematic cross-sectional view showing the polishing apparatus including an optical film-thickness measuring device.

FIG. 2 is a schematic cross-sectional view showing the polishing apparatus having the optical film-thickness measuring device 25. The polishing head shaft 16 is coupled to a polishing head motor 18 through a coupling device 17, such as belt, so that the polishing head shaft 16 is rotated by the polishing head motor 18. This rotation of the polishing head shaft 16 is transmitted to the polishing head 5 to rotate the polishing head 5 in the direction indicated by the arrow.

As described previously, the optical film-thickness measuring device 25 includes the sensor module 42 having the sensor head 31 and the processor 32. The sensor module 42 includes an optical device 47 having at least a light source and a spectrometer, and optical fibers 48 coupled to the optical device 47. The tip ends of the optical fibers 48 constitute the sensor head 31, and the other ends of the optical fibers 48 are coupled to the optical device 47. The optical device 47 is configured to emit light, which travels through the optical fibers 48 and is directed from the sensor head 31 to the surface, to be polished, of the wafer W. Reflected light from the wafer W is received by the sensor head 31 and is further transmitted to the optical device 47 through the optical fibers 48. The optical device 47 is configured to resolve the reflected light according to wavelength and measure intensity of the reflected light over a predetermined wavelength range.

The polishing table 3 has a sensor hole 50A and a drain hole 50B formed in the upper surface of the polishing table 3. The drain hole 50B functions as a table hole used in positioning of the polishing pad 1 with respect to the polishing table 3 as described later. The polishing pad 1 has a through-hole 51 at a position corresponding to the holes 50A and 50B. The holes 50A, 50B are in communication with the through-hole 51, and the through-hole 51 is located right above the holes 50A, 50B. The through-hole 51 has an upper open end lying in the polishing surface 1*a*. The sensor hole 50A is coupled to a liquid supply passage 53. This liquid supply passage 53 is coupled to a liquid supply source 55 via a rotary join (not shown). The drain hole 50B is coupled to a liquid discharge passage 54.

The sensor head 31, which is constituted by the tip ends of the optical fibers 48, is located in the sensor hole 50A, and is located close to the surface, to be polished, of the wafer W. The sensor head 31 is located so as to sweep across the surface, to be polished, of the wafer W held by the polishing head 5. Each time the polishing table 3 rotates, the light is directed to a plurality of areas of the wafer W.

During polishing of the wafer W, the liquid supply source 55 supplies water (preferably pure water) as a transparent liquid into the sensor hole 50A through the liquid supply passage 53. The water fills a space formed between the lower surface of the wafer W and the sensor head 31. The water further flows into the drain hole 50B and is expelled therefrom through the liquid discharge passage 54. The polishing liquid is discharged together with the water and thus a path of light is ensured. The liquid supply passage 53 is provided with a valve (not shown in the drawing) configured to operate in conjunction with the rotation of the polishing table 3. The valve operates so as to stop the flow of the water or reduce the flow of the water when the wafer W is not located over the through-hole 51.

During polishing of the wafer W, the sensor head 31 directs the light to the wafer W, and the sensor head 31 receives the reflected light from the wafer W. The optical device 47 measures the intensity of the reflected light at each of the wavelengths over a predetermined wavelength range, and transmits light intensity data obtained to the processor 32. This light intensity data is an optical signal reflecting a film thickness of the wafer W, and contains the intensities of the reflected light and the corresponding wavelengths. The processor 32 produces, from the light intensity data, a spectral waveform representing the intensity of the light at each of the wavelengths. The processor 32 performs a Fourier transform process (e.g., fast Fourier transform process) on the spectral waveform to produce a frequency spectrum and determines a film thickness of the wafer W from the frequency spectrum.

Figure 3:
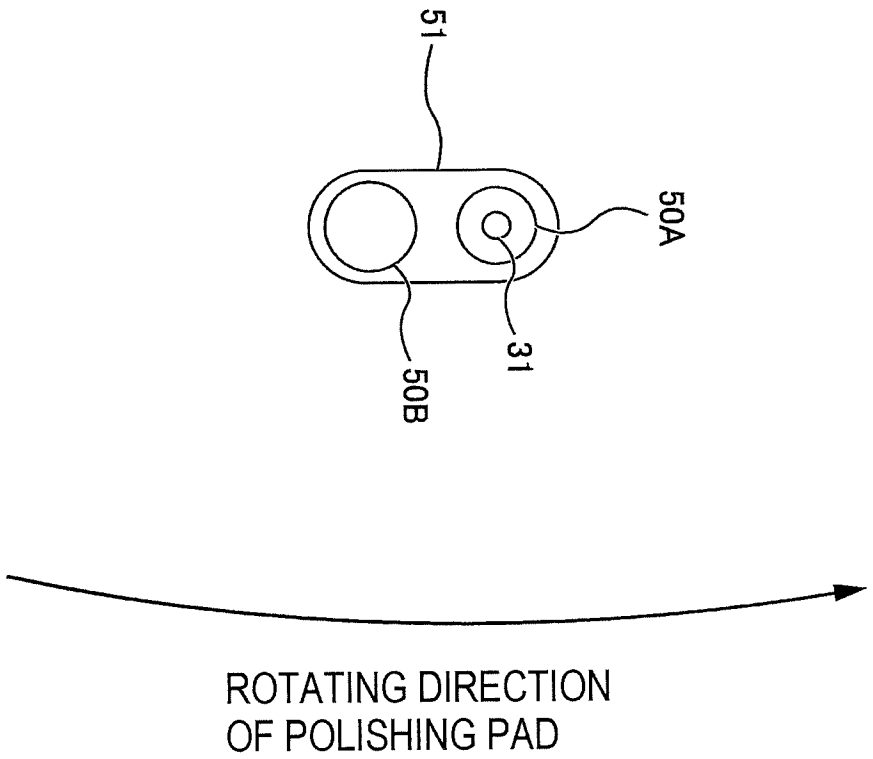
FIG. 3 is a top view of a through-hole of a polishing pad shown in FIG. 2.

FIG. 3 is a top view of the through-hole 51 of the polishing pad 1 shown in FIG. 2. The through-hole 51 of the polishing pad 1 has an elliptical cross section. The sensor hole 50A and the drain hole 50B are adjacent to each other, and are arranged along the rotational direction of the polishing table 3. A width of the through-hole 51 of the polishing pad 1 is larger than a width of the sensor hole 50A and a width of the drain hole 50B, so that open ends of the sensor hole 50A and the drain hole 50B are located in the through-hole 51 of the polishing pad 1. The sensor head 31 is arranged in the sensor hole 50A. The water that has been supplied to the sensor hole 50A through the liquid supply passage 53 and the polishing liquid (e.g., slurry) that has been used in polishing the wafer W are drained through the drain hole 50B.

The polishing pad 1 gradually wears as polishing of wafers and dressing of the polishing pad 1 are repeated. Therefore, the polishing pad 1 is a consumable item. When the wear of the polishing pad 1 progresses to some extent, it is replaced with a new polishing pad.

Figure 4:
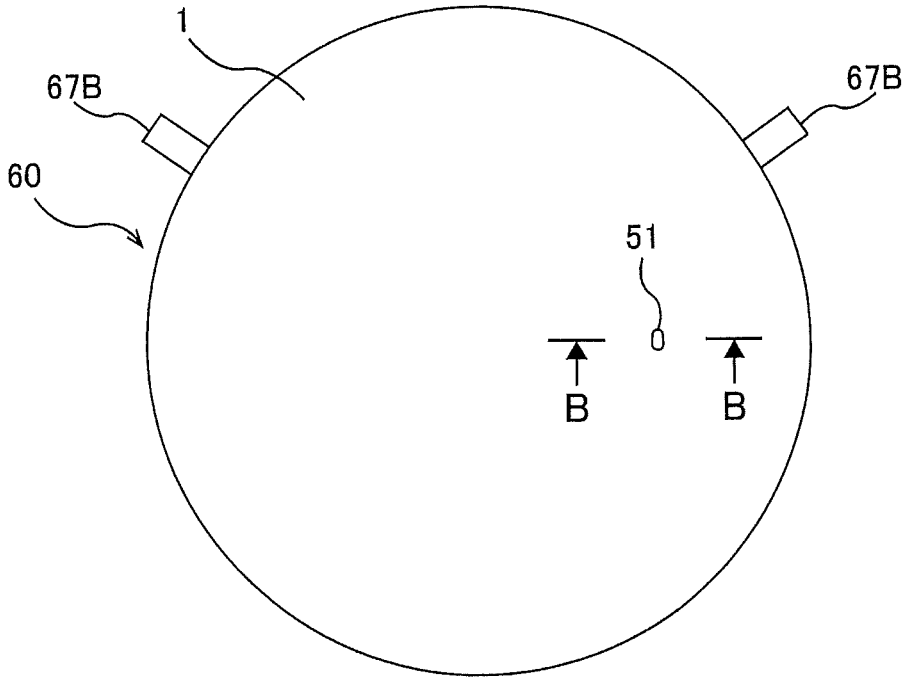
FIG. 4 is a top view showing a polishing-pad laminated structure having a new polishing pad.
Figure 5:
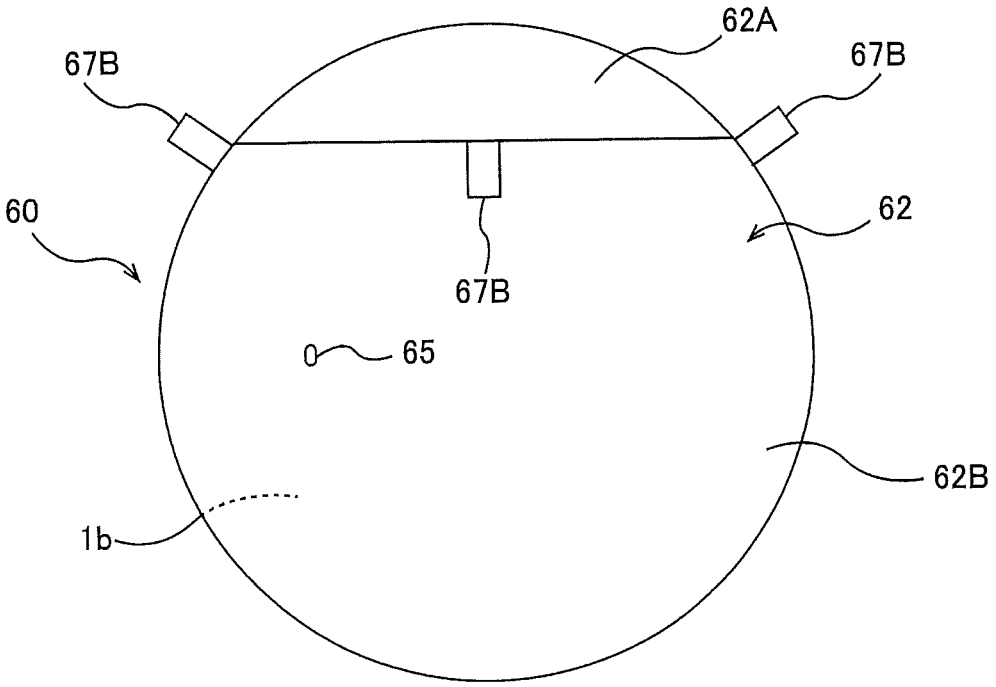
FIG. 5 is a backside view of the polishing-pad laminated structure shown in FIG. 4.
Figure 6:
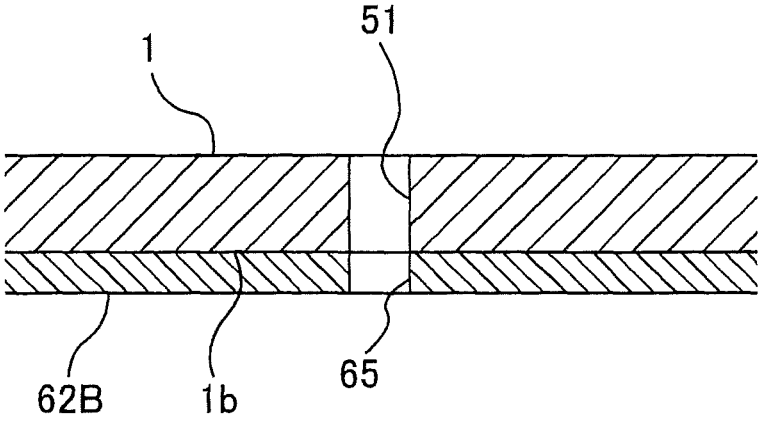
FIG. 6 is a cross-sectional view taken along a line B-B in FIG. 4.

FIG. 4 is a top view showing a polishing-pad laminated structure 60 including a new polishing pad 1, FIG. 5 is a backside view of the polishing-pad laminated structure 60 shown in FIG. 4, and FIG. 6 is a cross-sectional view taken along a line B-B in FIG. 4. The polishing-pad laminated structure 60 includes the new polishing pad 1 and a release sheet 62 covering an adhesive surface 1*b* constituting a back surface of the polishing pad 1. The release sheet 62 is made of a flexible sheet material, such as paper or a resin film, which can be easily removed from the adhesive surface 1*b*. The polishing pad 1 has the through-hole 51 at a position corresponding to the position of the sensor head 31 disposed in the polishing table 3. The release sheet 62 has a through-hole 65 at the same position as the through-hole 51 of the polishing pad 1. The through-hole 51 of the polishing pad 1 are aligned with the through-hole 65 of the release sheet 62.

The release sheet 62 has the same size and the same shape as the polishing pad 1 and is attached to the entire adhesive surface 1*b* of the polishing pad 1. In the present embodiment, the polishing pad 1 and the release sheet 62 are in a circular shape. The release sheet 62 is divided into a first release sheet 62A and a second release sheet 62B. The first release sheet 62A and the second release sheet 62B cover the entire adhesive surface 1*b* of the polishing pad 1, and can be peeled off (or removed) from the adhesive surface 1*b*. In the present embodiment, the first release sheet 62A has a crescent shape. The first release sheet 62A has a surface area smaller than that of the second release sheet 62B. The first release sheet 62A and the second release sheet 62B are next to each other. In one embodiment, the release sheet 62 may be divided into three or more release sheets.

The through-hole 65 of the release sheet 62 are formed in the second release sheet 62B. Three release assisting projections 67B for assisting the removing of the second release sheet 62B are connected to the second release sheet 62B. One of the three release assisting projections 67B is connected to an inner edge of the second release sheet 62B, and the other two release assisting projections 67B are connected to both outer edges of the second release sheet 62B. It is noted, however, the arrangement of the release assisting projections 67B is not limited to the present embodiment. In one embodiment, only one or only two of the three release assisting projections 67B may be provided. In one embodiment, four or more release assisting projections 67B may be connected to the second release sheet 62B. A plurality of release assisting projections 67B may be connected to the inner edge of the second release sheet 62B, or three or more release assisting projections 67B may be connected to the outer edge of the second release sheet 62B. Furthermore, in one embodiment, the release assisting projection 67B may not be provided.

The release assisting projection 67B has a sheet or tape shape, and has a size that allows a user to pinch it. The release assisting projections 67B may be integral with the second release sheet 62B, or may be tape materials attached to the second release sheet 62B by adhesives. In the present embodiment, no release assisting projection is connected to the first release sheet 62A, but one or more release assisting projections for assisting the removing of the first release sheet 62A may be connected to the first peeling sheet 62A.

Next, operations of attaching the polishing pad 1 to the polishing table 3 will be described with reference to a flowchart of FIG. 7.

In step 1, a user peels off the first release sheet 62A from the adhesive surface (back surface) 1*b* of the polishing pad 1.

In step 2, the polishing-pad laminated structure 60 is placed on the pad support surface 3*b* of the polishing table 3 with the second release sheet 62B covering the adhesive surface 1*b* of the polishing pad 1. Although the first release sheet 62A has been removed from the polishing pad 1, at this stage an exposed portion of the adhesive surface 1*b* of the polishing pad 1 (i.e., a portion that has been covered by the first release sheet 62A) does not adhere to the pad support surface 3*b* of the polishing table 3. Therefore, the polishing-pad laminated structure 60 can be freely moved on the polishing table 3.

In step 3, the through-hole 51 of the polishing pad 1 is aligned with the sensor head 31 in the polishing table 3.

In step 4, with the through-hole 51 of the polishing pad 1 aligned with the sensor head 31, the exposed portion of the adhesive surface 1*b* of the polishing pad 1 (i.e., the portion that has been covered by the first release sheet 62A) is pressed strongly against the pad support surface 3*b* of the polishing table 3, whereby the part of the adhesive surface 1*b* of the polishing pad 1 is attached to the pad support surface 3*b* of the polishing table 3.

In step 5, the user grips the release assisting projections 67B with fingers and peels the second release sheet 62B from the adhesive surface 1*b* of the polishing pad 1. Since the release assisting projections 67B are connected to the edge of the second release sheet 62B, peeling of the second release sheet 62B begins at its edge, making it easy to remove the second release sheet 62B.

In step 6, a remaining part of the adhesive surface 1*b* of the polishing pad 1 is strongly pressed against the pad support surface 3*b* of the polishing table 3, whereby the entire adhesive surface 1*b* of the polishing pad 1 is attached to the pad support surface 3*b* of the polishing table 3.

According to the present embodiment, adjustment of the position of the polishing pad 1 with respect to the polishing table 3 is performed in a state where the first release sheet 62A having a small surface area has been removed. Since the polishing-pad laminated structure 60 can be moved relatively freely on the polishing table 3, the through-hole 51 of the polishing pad 1 can be precisely aligned with the sensor head 31 disposed in the polishing table 3. In particular, according to the present embodiment, at the time of aligning the through-hole 51, the adhesive layer 1*b* around the through-hole 51 remains covered with the second release sheet 62B, and therefore fine adjustment of the position of the through-hole 51 can be easily conducted. Further, immediately after the alignment between the through-hole 51 of the polishing pad 1 and the sensor head 31 is completed, the exposed portion (i.e., the portion that has been covered with the first release sheet 62A) of the adhesive surface 1*b* of the polishing pad 1 is pressed against the polishing table 3, so that the relative position of the polishing pad 1 with respect to the polishing table 3 can be fixed.

Figure 8A:
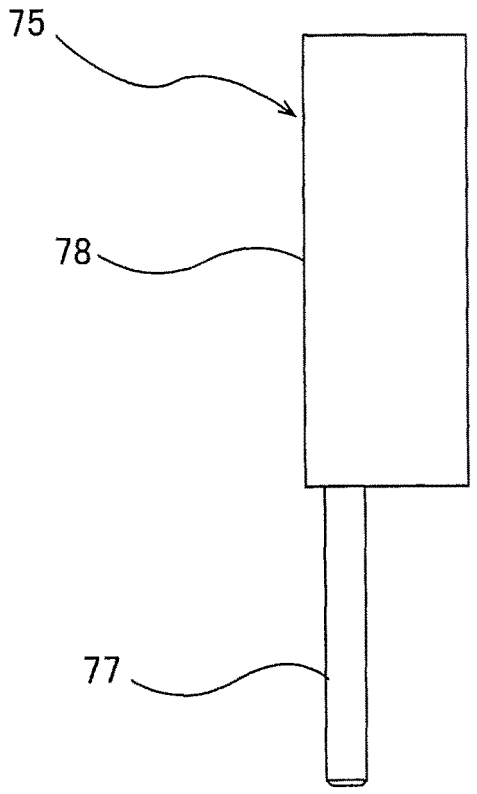
FIG. 8A is a side view of a positioning structure used to position the polishing pad with respect to the polishing table.
Figure 8B:
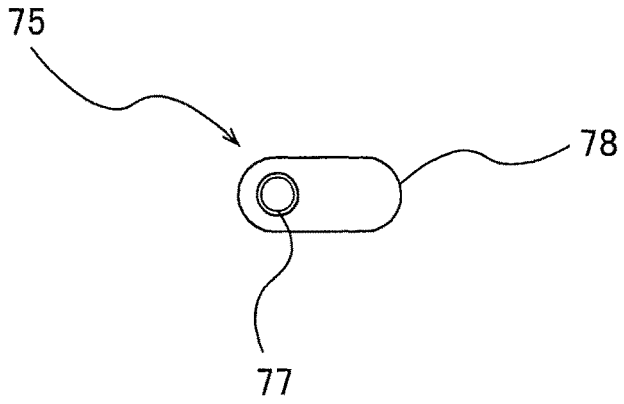
FIG. 8B is a bottom view of the positioning structure shown in FIG. 8A.

In order to facilitate the operation of aligning the through-hole 51 of the polishing pad 1 with the sensor head 31 and to improve the alignment accuracy, in one embodiment, a positioning structure 75 shown in FIGS. 8A and 8B is used. FIG. 8A is a side view of the positioning structure 75 used to position the polishing pad 1 with respect to the polishing table 3, and FIG. 8B is a bottom view of the positioning structure 75 shown in FIG. 8A. The positioning structure 75 includes a first positioning protrusion 77 configured to be able to be inserted into the drain hole 50B (see FIG. 2) as a table hole formed in the pad support surface 3*b* of the polishing table 3, and a second positioning protrusion 78 fixed to the first positioning protrusion 77. The second positioning protrusion 78 is located on the upper side of the first positioning protrusion 77.

The positioning structure 75 is detachably attached to the pad support surface 3*b* of the polishing table 3. The positioning structure 75 constitutes at least a part of a polishing-pad positioning instrument for positioning the polishing pad 1 with respect to the polishing table 3.

Figure 9:
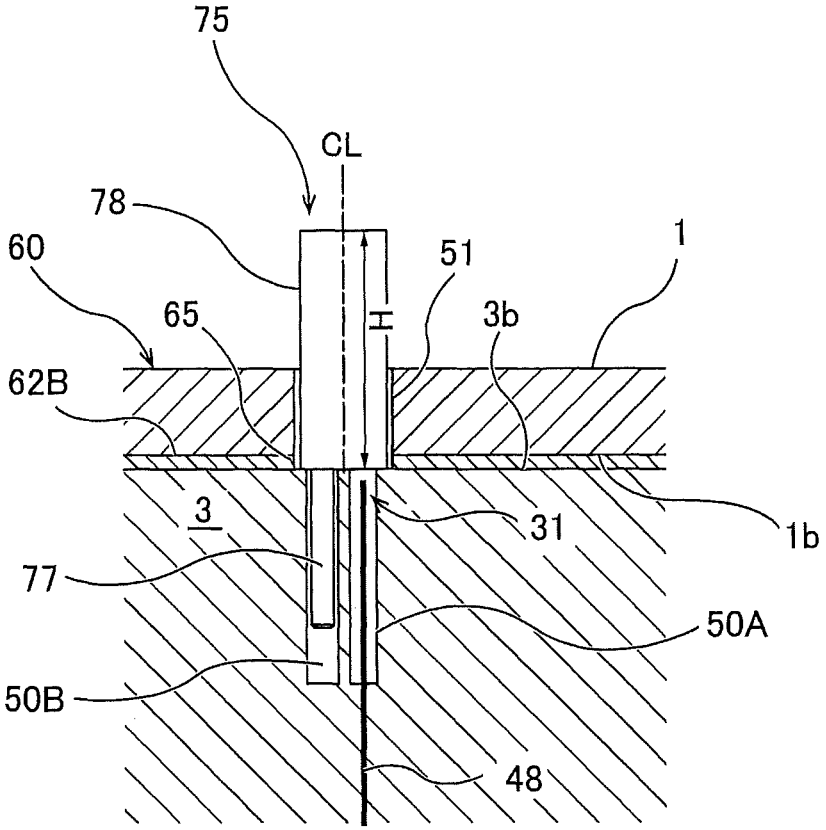
FIG. 9 is a cross-sectional view showing the positioning structure in a state in which a first positioning protrusion is inserted into a drain hole of the polishing table.

FIG. 9 is a cross-sectional view showing the positioning structure 75 with its first positioning protrusion 77 inserted into the drain hole 50B of the polishing table 3. The first positioning protrusion 77 has a cross section that can be inserted into the drain hole 50B as a table hole formed in the pad support surface 3*b* of the polishing table 3. The length of the first positioning protrusion 77 is shorter than the length of the drain hole 50B, so that the entire first positioning protrusion 77 can be inserted into the drain hole 50B. In the present embodiment, the first positioning protrusion 77 has a pin shape. However, the shape and the length of the first positioning protrusion 77 are not limited to the present embodiment, and are determined based on the shape and the length of the table hole formed in the pad support surface 3*b*.

In the present embodiment, the cross section of the first positioning protrusion 77 is smaller than the cross section of the second positioning protrusion 78. In a case where the cross section of the table hole is large, the cross section of the first positioning protrusion 77 may have the same shape and the same size as those of the cross section of the second positioning protrusion 78. Furthermore, in one embodiment, the cross section of the first positioning protrusion 77 may be larger than the cross section of the second positioning protrusion 78.

When the first positioning protrusion 77 is placed in the drain hole 50B, the second positioning protrusion 78 protrudes upward from the pad support surface 3*b* of the polishing table 3. The second positioning protrusion 78 has the cross-sectional shape corresponding to the cross-sectional shape of the through-hole 51 of the polishing pad 1. In the present embodiment, since the through-hole 51 of the polishing pad 1 has an elliptical cross section, the cross section of the second positioning protrusion 78 is in an elliptical shape slightly smaller than the cross section of the through-hole 51 of the polishing pad 1. A length H of the second positioning protrusion 78 along a central axis CL of the second positioning protrusion 78 is equal to or greater than the thickness of the polishing pad 1.

Figure 10:
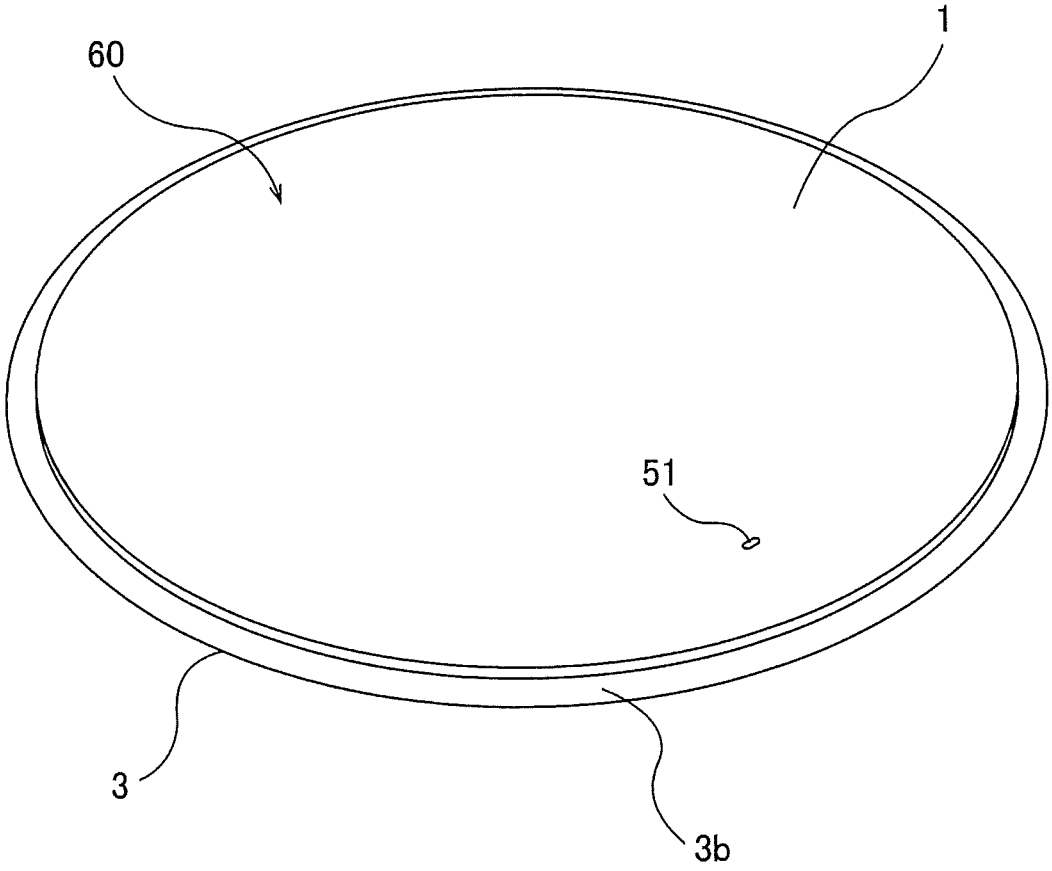
FIG. 10 is a diagram showing a process of attaching the polishing pad to the polishing table using the positioning structure.
Figure 11A:
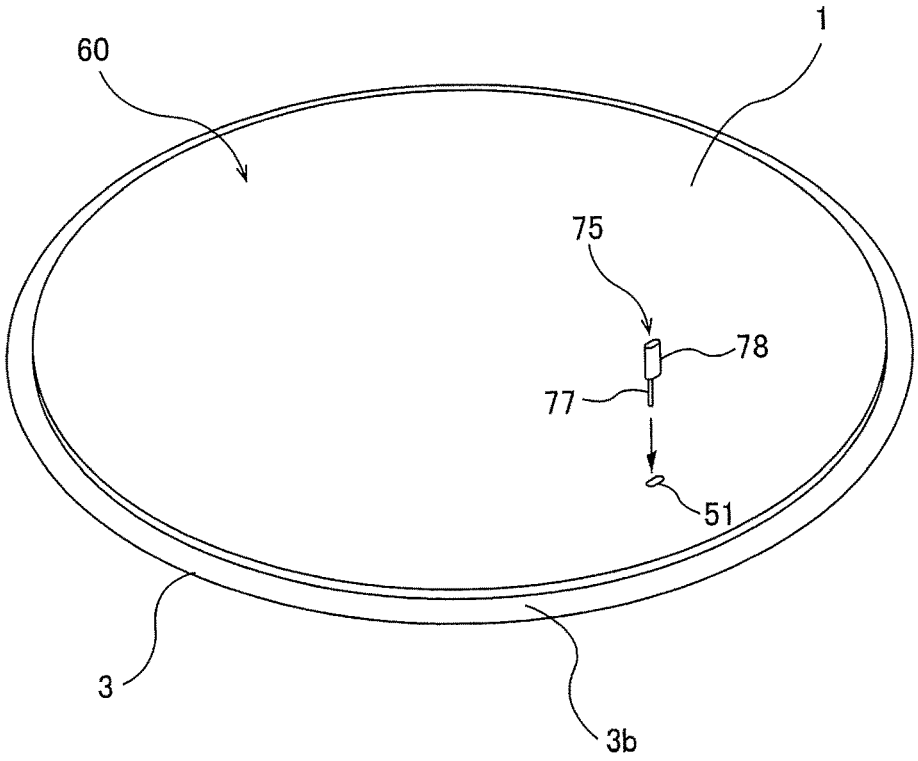
FIGS. 11A and 11B are diagrams each illustrating a process of attaching the polishing pad to the polishing table using the positioning structure.
Figure 11B:
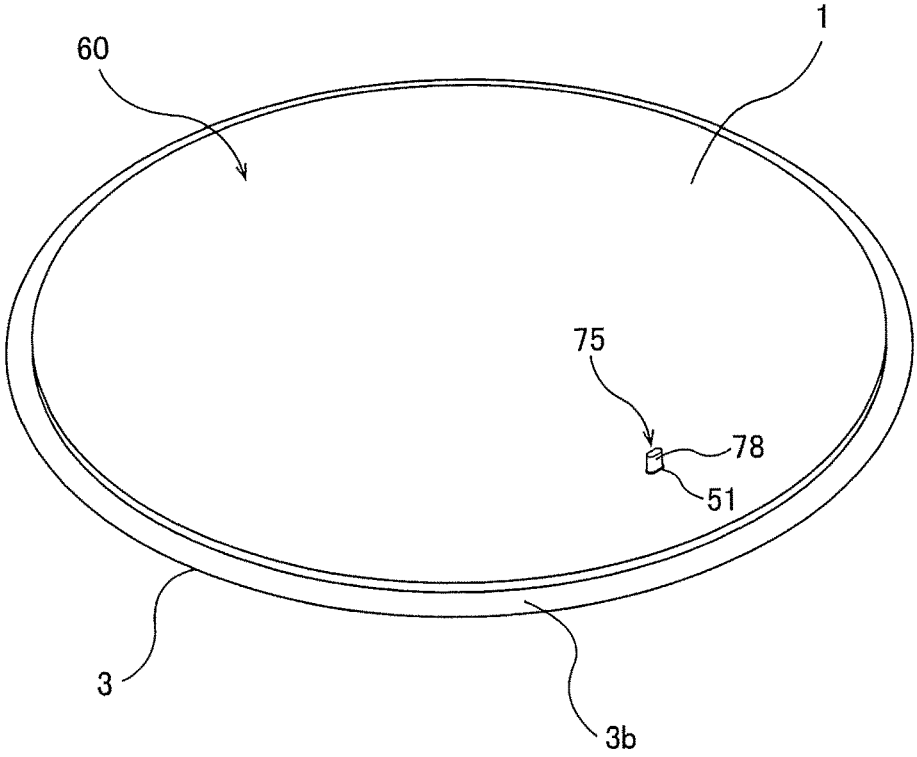

The polishing pad 1 is attached to the polishing table 3 as follows using the positioning structure 75 as a polishing-pad positioning instrument. First, as shown in FIG. 10, the polishing-pad laminated structure 60 from which the first release sheet 62A has been removed is placed on the pad support surface 3*b* of the polishing table 3. Next, as shown in FIGS. 11A and 11B and FIG. 9, the first positioning protrusion 77 of the positioning structure 75 is inserted into the drain hole 50B of the polishing table 3 through the through-hole 51 of the polishing pad 1 and the through-hole 65 of the second release sheet 62B. Further, the second positioning protrusion 78 is inserted into the through-hole 51 of the polishing pad 1 and the through-hole 65 of the second release sheet 62B. The through-hole 51 of the polishing pad 1 is aligned with the sensor head 31 disposed in the polishing table 3 by the second positioning protrusion 78 inserted into the through-hole 51 of the polishing pad 1.

Next, the exposed portion (i.e., the portion that has been covered by the first release sheet 62A) of the adhesive surface (back surface) 1*b* of the polishing pad 1 is attached to the pad support surface 3*b* of the polishing table 3. Thus, the relative position of the polishing-pad laminated structure 60 with respect to the polishing table 3 is fixed. Thereafter, the positioning structure 75 is removed from the polishing table 3 and the polishing pad 1. Furthermore, the second release sheet 62B is peeled off from the polishing pad 1, and the entire adhesive surface 1*b* of the polishing pad 1 is attached to the pad support surface 3*b* of the polishing table 3.

According to the present embodiment, the positioning of the polishing pad 1 with respect to the polishing table 3 is completed by inserting the second positioning protrusion 78 of the positioning structure 75 into the through-hole 51 of the polishing pad 1. Thus, the attaching work of the polishing pad 1 can be facilitated.

In one embodiment, the positioning structure 75 may be attached to the polishing table 3 before the polishing pad 1 is placed on the polishing table 3. Specifically, first, the first positioning protrusion 77 of the positioning structure 75 is inserted into the drain hole 50B of the polishing table 3. Next, the polishing-pad laminated structure 60 from which the first release sheet 62A has been removed is placed on the pad support surface 3*b* of the polishing table 3. At this time, the second positioning protrusion 78 is inserted into the through-hole 51 of the polishing pad 1 and the through-hole 65 of the second release sheet 62B. The through-hole 51 of the polishing pad 1 is aligned with the sensor head 31 disposed in the polishing table 3 by the second positioning protrusion 78 inserted into the through-hole 51 of the polishing pad 1. Next, the exposed portion (i.e., the portion that has been covered by the first release sheet 62A) of the adhesive surface 1*b* of the polishing pad 1 is attached to the pad support surface 3*b* of the polishing table 3. Thus, the relative position of the polishing-pad laminated structure 60 with respect to the polishing table 3 is fixed. Thereafter, the positioning structure 75 is removed from the polishing table 3 and the polishing pad 1. Furthermore, the second release sheet 62B is peeled off from the polishing pad 1, and the entire adhesive surface 1*b* of the polishing pad 1 is attached to the pad support surface 3*b* of the polishing table 3.

Figure 12:
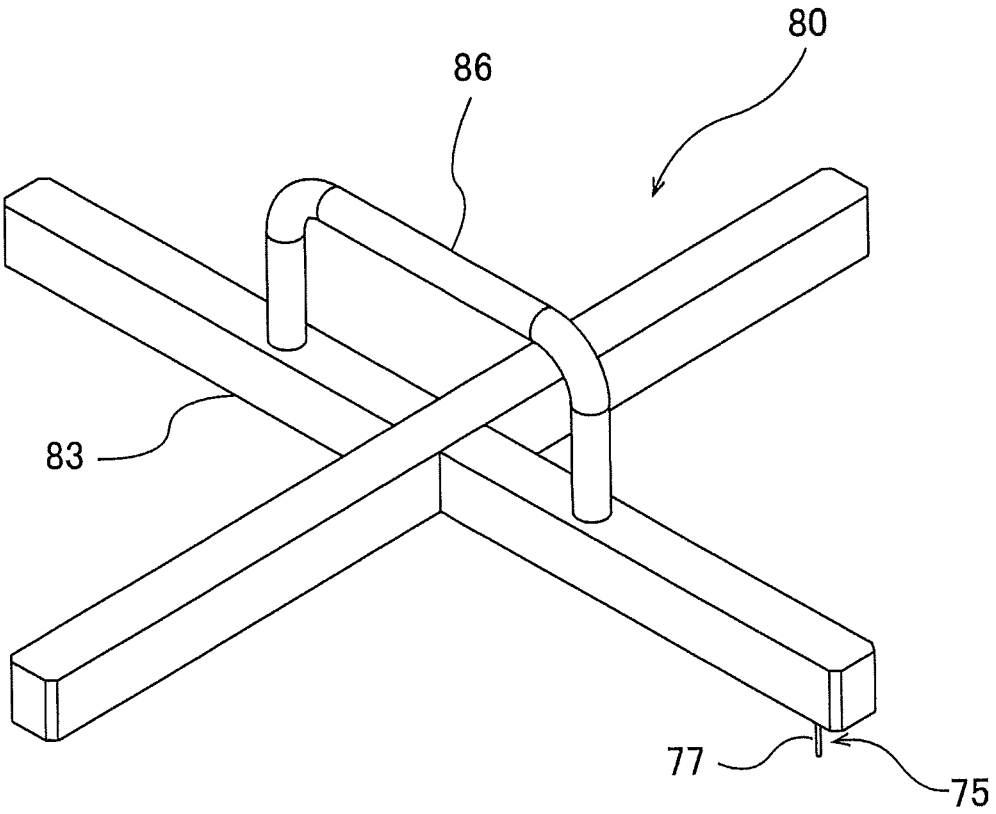
FIG. 12 is a perspective view showing another embodiment of the polishing-pad positioning instrument.
Figure 13:
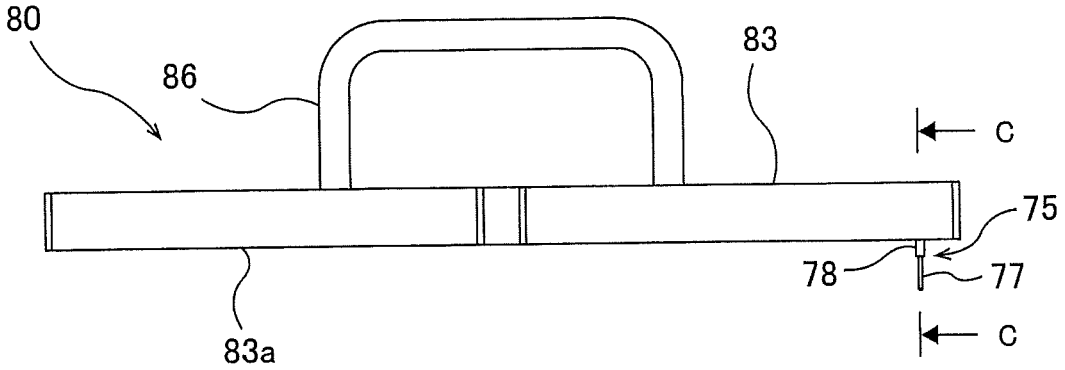
FIG. 13 is a front view of the polishing-pad positioning instrument shown in FIG. 12.
Figure 14:
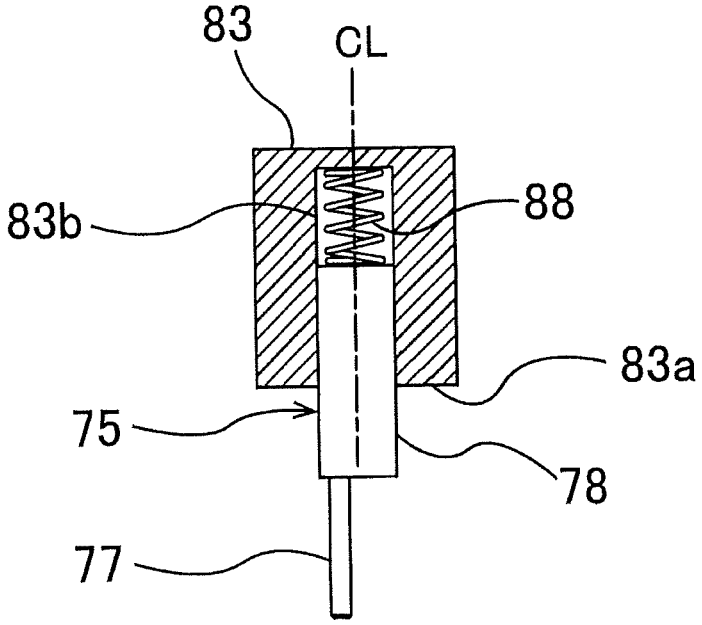
FIG. 14 is a cross-sectional view taken along a line C-C of FIG. 13.

FIG. 12 is a perspective view showing another embodiment of a polishing-pad positioning instrument, FIG. 13 is a front view of the polishing-pad positioning instrument shown in FIG. 12, and FIG. 14 is a cross-sectional view taken along a line C-C of FIG. 13. In the present embodiment, a polishing-pad positioning instrument 80 includes a support structure 83 for supporting the second positioning protrusion 78 of the positioning structure 75. The support structure 83 serves as a structure for preventing the entire positioning structure 75 from falling when the first positioning protrusion 77 is inserted into the drain hole 50B of the polishing table 3. The entire first positioning protrusion 77 and the lower portion of the second positioning protrusion 78 project downward from a bottom surface 83*a* of the support structure 83.

In order to stabilize the posture of the positioning structure 75, the bottom surface 83*a* of the support structure 83 is perpendicular to the central axis CL (see FIG. 14) of the second positioning protrusion 78. In the present embodiment, the support structure 83 has a cross shape. However, the entire support structure 83 may have another shape such as a flat plate shape or a disk shape, as long as the bottom surface 83*a* of the support structure 83 is perpendicular to the central axis CL of the second positioning protrusion 78. In the present embodiment, a handle 86 is secured to the top of the support structure 83.

As shown in FIG. 14, the support structure 83 has a vertical hole 83*b* extending perpendicularly to the bottom surface 83*a*. The upper portion of the second positioning protrusion 78 is housed in the vertical hole 83*b*. The second positioning protrusion 78 is supported by the support structure 83 so as to be movable along the central axis CL of the second positioning protrusion 78. The polishing-pad positioning instrument 80 includes a spring 88 disposed between the second positioning protrusion 78 and the support structure 83. The spring 88 is located in the vertical hole 83*b* and configured to force the positioning structure 75 in an extending direction of the central axis CL of the second positioning protrusion 78. The structure and position of the spring 88 are not limited to this embodiment as long as the spring 88 can force the positioning structure 75 in the extending direction of the central axis CL of the second positioning protrusion 78. In the present embodiment, the extending direction of the central axis CL of the second positioning protrusion 78 is parallel to the longitudinal direction of the first positioning protrusion 77.

Figure 15:
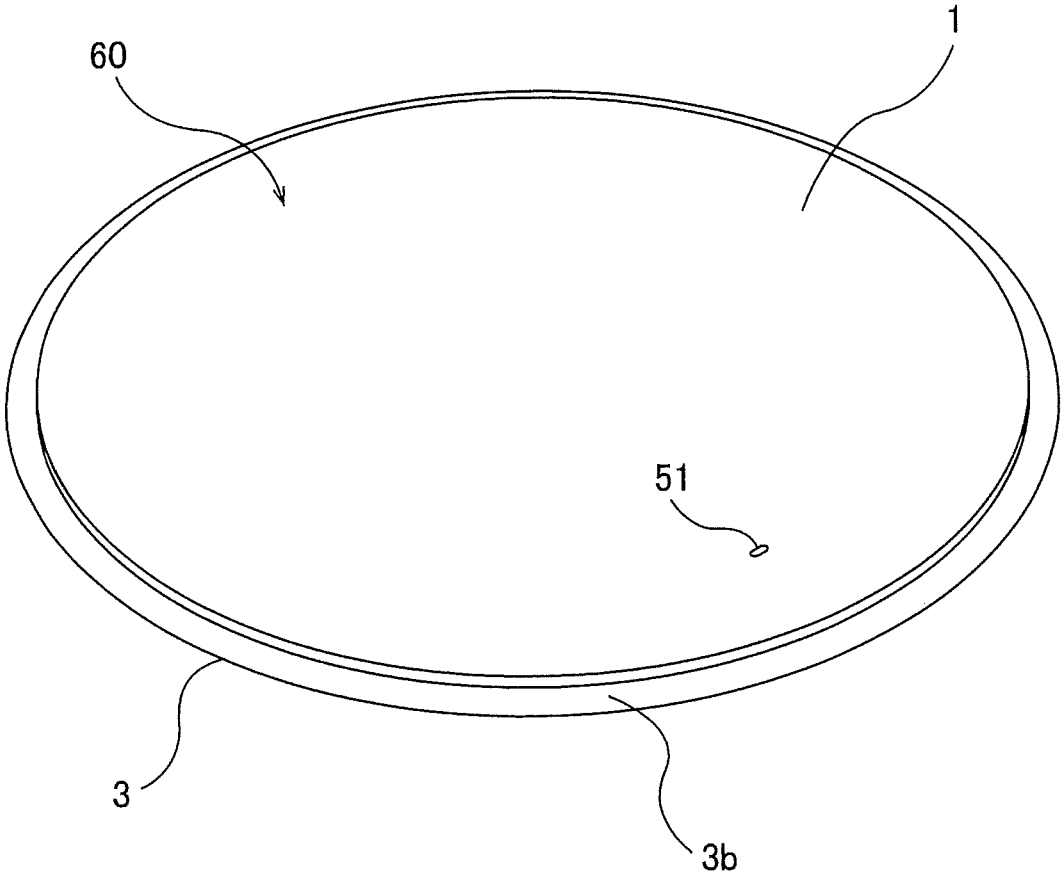
FIG. 15 is a view showing a process of attaching a polishing pad to a polishing table using the polishing-pad positioning instrument.
Figure 16A:
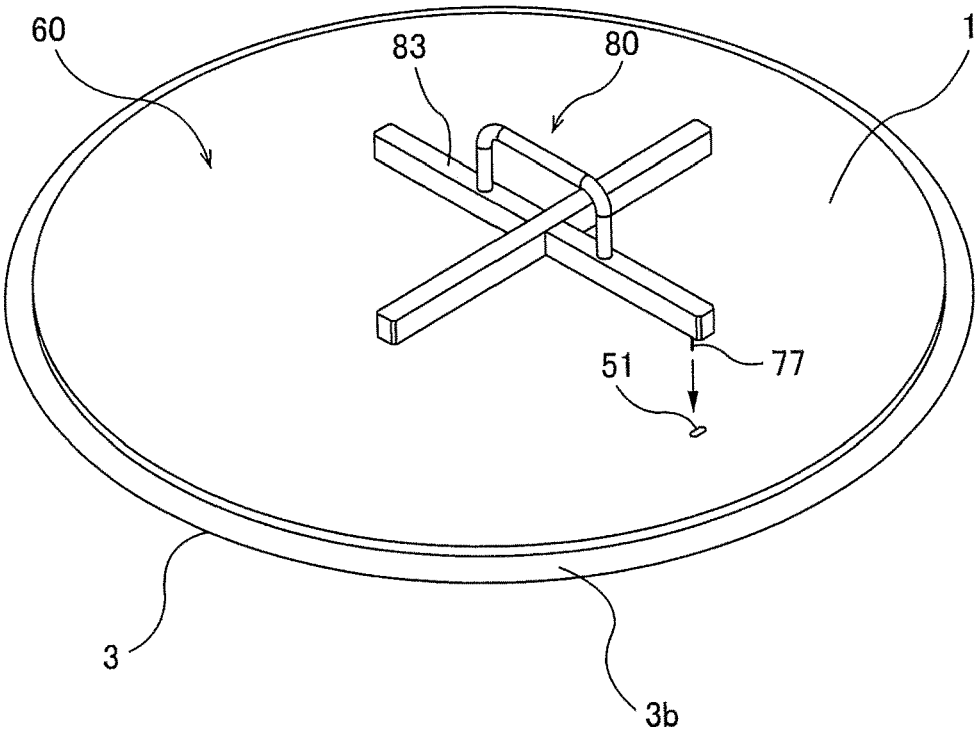
FIGS. 16A and 16B are diagrams each showing a process of attaching the polishing pad to the polishing table using the polishing-pad positioning instrument.
Figure 16B:
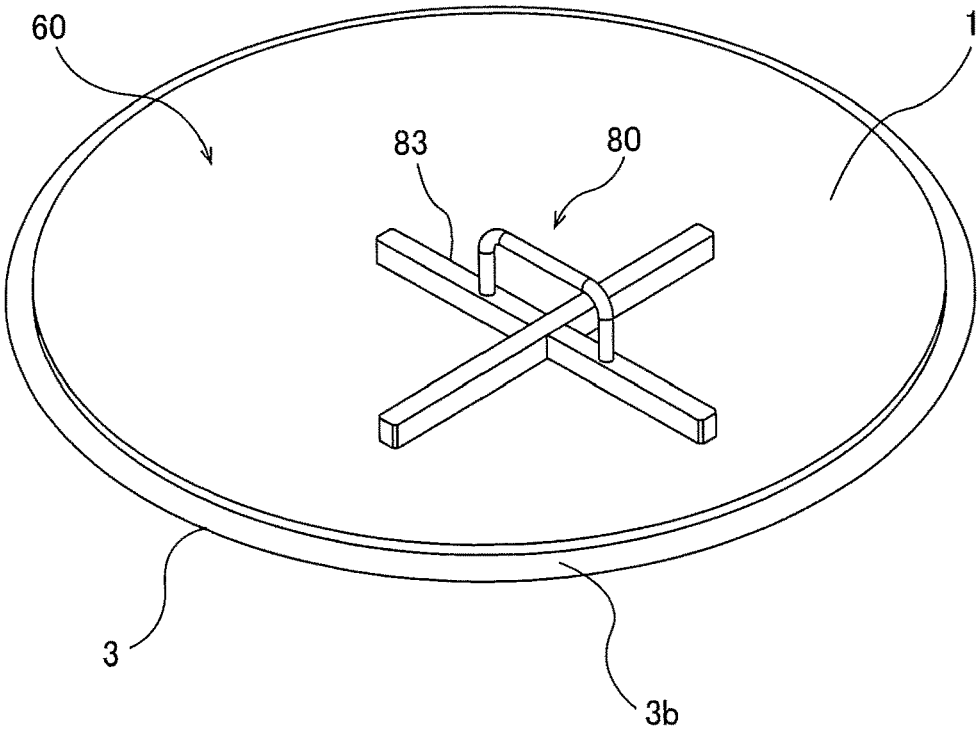
Figure 17:
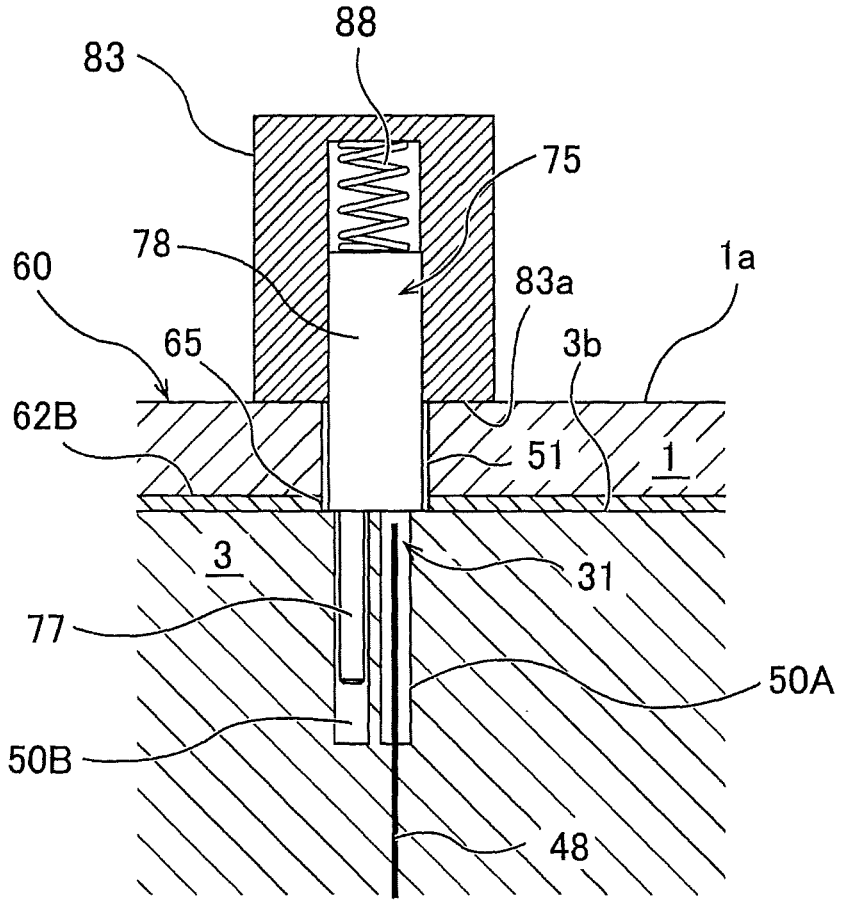
FIG. 17 is a cross-sectional view showing a positional relationship among the positioning structure, the polishing-pad laminated structure, and the polishing table.

The polishing-pad positioning instrument 80 shown in FIG. 12 is used as follows. First, as shown in FIG. 15, the polishing-pad laminated structure 60 from which the first release sheet 62A has been removed is placed on the pad support surface 3*b* of the polishing table 3. Next, as shown in FIGS. 16A and 16B, the polishing-pad positioning instrument 80 is placed on the polishing pad 1. At this time, as shown in FIG. 17, the first positioning protrusion 77 is inserted into the drain hole 50B of the polishing table 3 through the through-hole 51 of the polishing pad 1 and the through-hole 65 of the second release sheet 62B. Further, the second positioning protrusion 78 is inserted into the through-hole 51 of the polishing pad 1 and the through-hole 65 of the second release sheet 62B. The through-hole 51 of the polishing pad 1 is aligned with the sensor head 31 disposed in the polishing table 3 by the second positioning protrusion 78 inserted into the through-hole 51 of the polishing pad 1.

Next, while the polishing pad 1 is being pressed against the polishing table 3 by the support structure 83 of the polishing-pad positioning instrument 80, the exposed portion (i.e., the portion that has been covered with the first release sheet 62A) of the adhesive surface 1*b* of the polishing pad 1 is attached to the pad support surface 3*b* of the polishing table 3. Thus, the relative position of the polishing-pad laminated structure 60 with respect to the polishing table 3 is fixed. When the polishing-pad positioning instrument 80 is pressed against the upper surface (polishing surface) 1*a* of the polishing pad 1, the support structure 83 is moved against the force of the spring 88, until the bottom surface 83*a* of the support structure 83 is brought into contact with the upper surface (polishing surface) 1*a* of the polishing pad 1. Therefore, the support structure 83 of the polishing-pad positioning instrument 80 can press the polishing pad 1 against the polishing table 3 while the first positioning protrusion 77 is inserted into the drain hole 50B.

After the exposed portion of the adhesive surface 1*b* of the polishing pad 1 is attached to the pad support surface 3*b* of the polishing table 3, the polishing-pad positioning instrument 80 is removed from the polishing table 3 and the polishing pad 1. Further, the second release sheet 62B is peeled off from the polishing pad 1, and the entire adhesive surface 1*b* of the polishing pad 1 is attached to the pad support surface 3*b* of the polishing table 3.

Figure 18A:
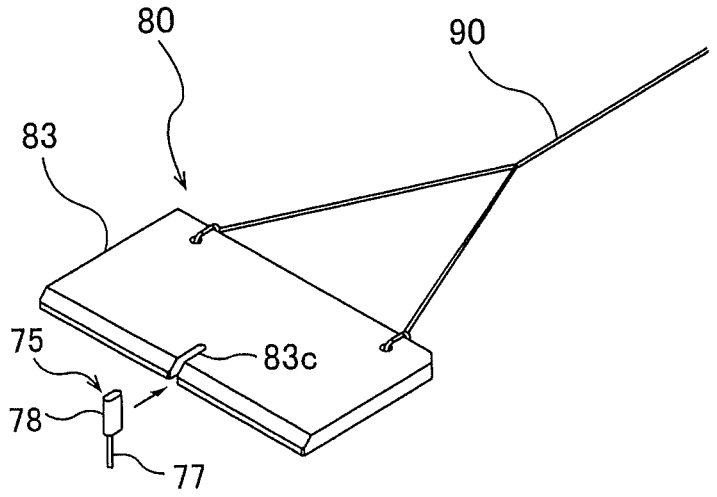
FIGS. 18A and 18B are perspective views each showing still another embodiment of the polishing-pad positioning instrument.
Figure 18B:
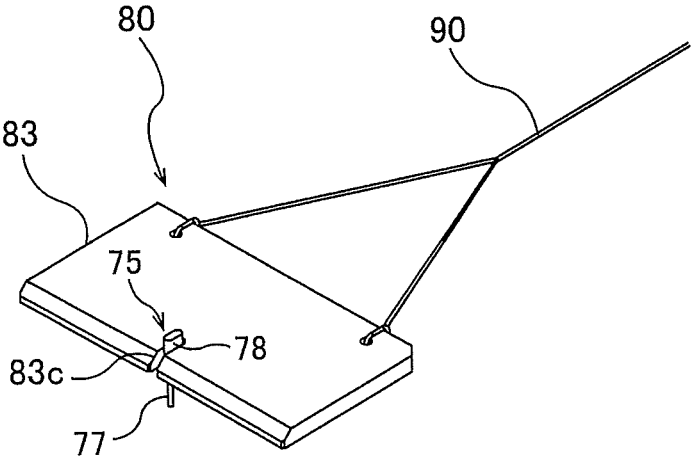

FIGS. 18A and 18B are perspective views each showing still another embodiment of a polishing-pad positioning instrument 80. The polishing-pad positioning instrument 80 includes a plate-shaped support structure 83 to which the positioning structure 75 is detachably attached. As shown in FIG. 18A, a slit 83*c* is formed in one edge of the support structure 83. This slit 83*c* has a shape with which the second positioning protrusion 78 of the positioning structure 75 can engage. The second positioning protrusion 78 is slid into the slit 83*c*, so that the positioning structure 75 is attached to the support structure 83 as shown in FIG. 18B. A string 90 is connected to the opposite edge of the support structure 83.

Figure 19A:
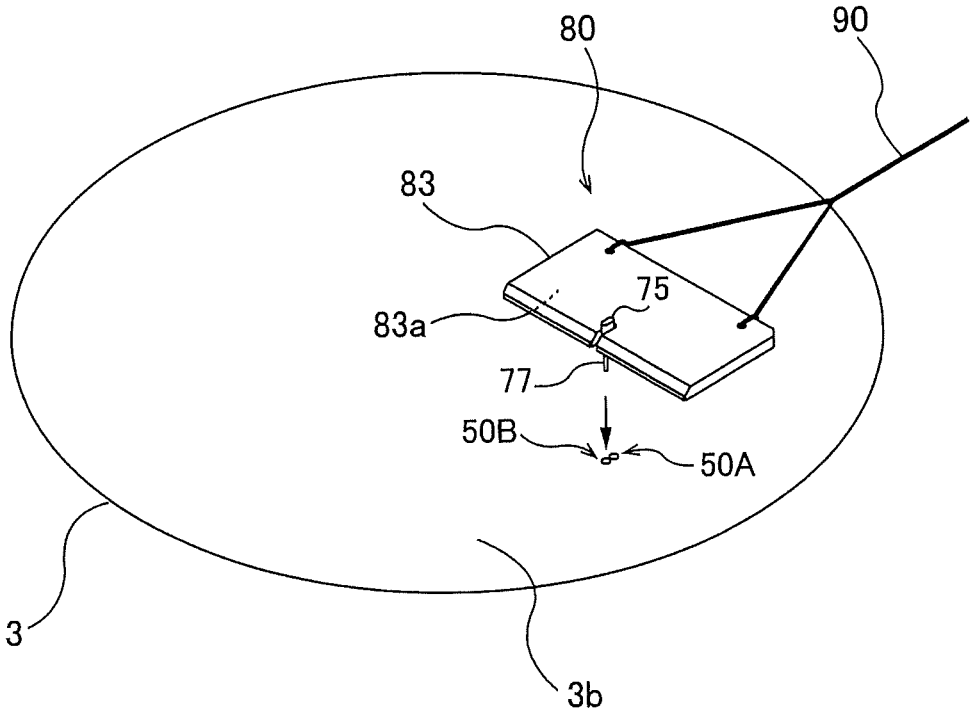
FIGS. 19A and 19B are diagrams each showing a process of attaching a polishing pad to a polishing table using the polishing-pad positioning instrument.
Figure 19B:
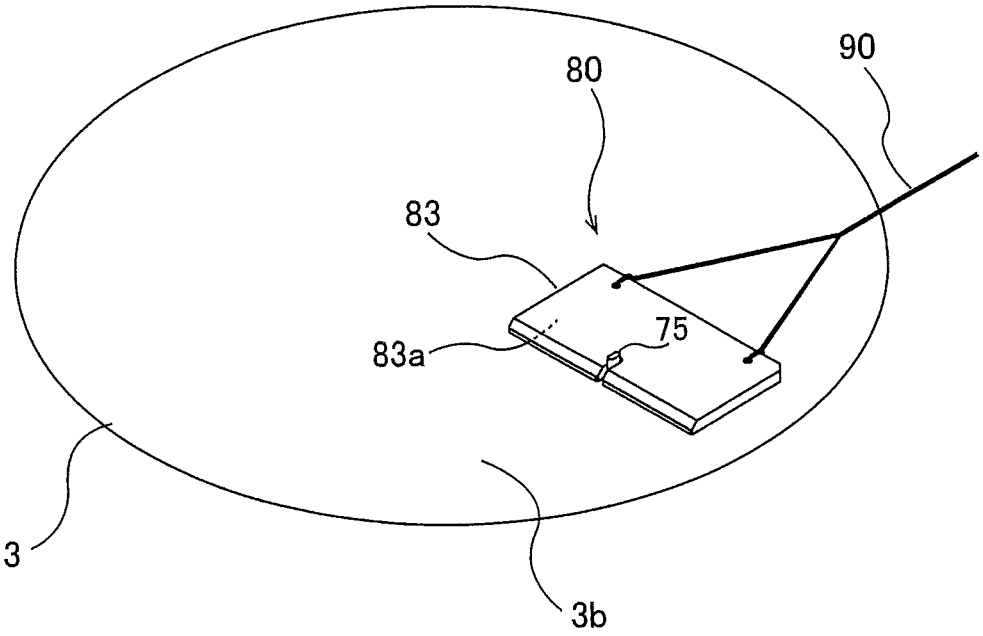
Figure 20:
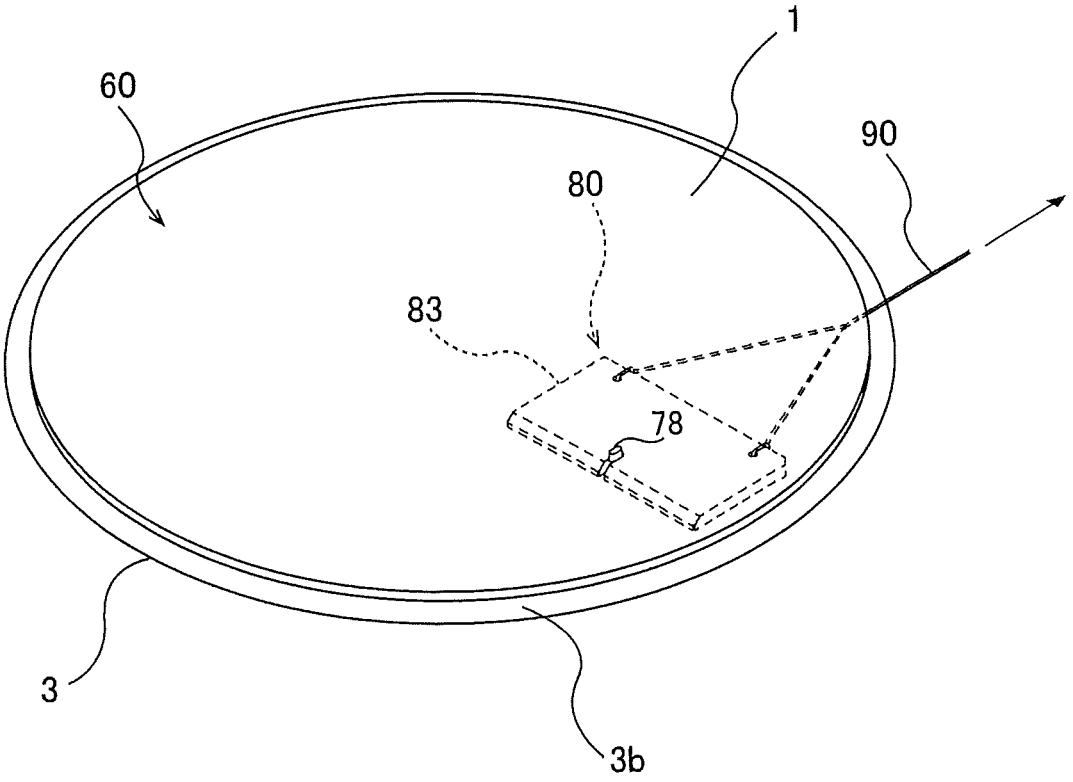
FIG. 20 is a view showing a process of attaching the polishing pad to the polishing table using the polishing-pad positioning instrument.
Figure 21:
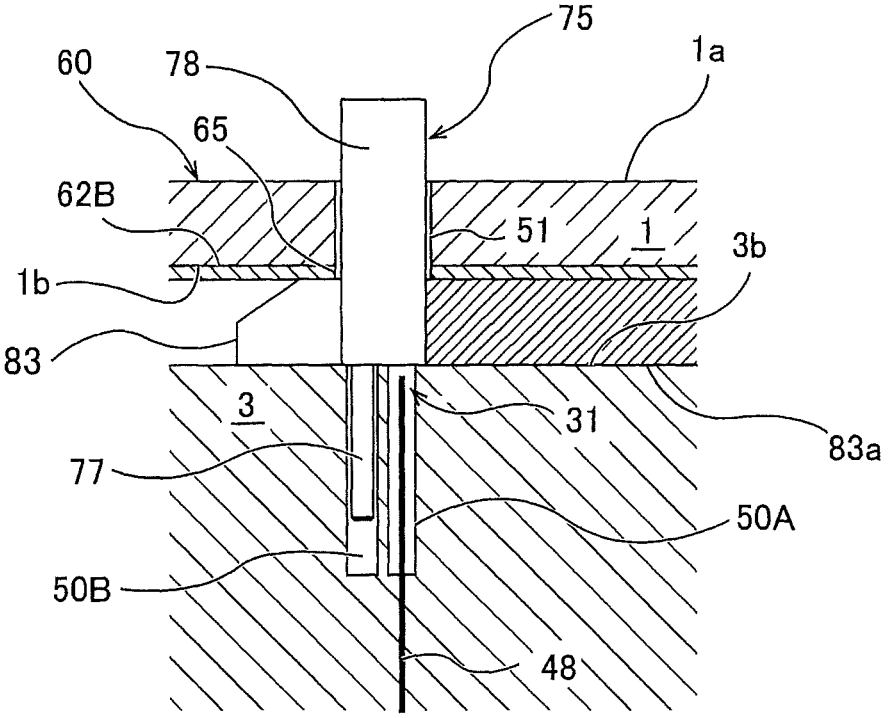
FIG. 21 is a cross-sectional view showing a positional relationship among the positioning structure, the polishing-pad laminated structure, and the polishing table.

The polishing-pad positioning instrument 80 shown in FIGS. 18A and 18B is used as follows. First, as shown in FIGS. 19A and 19B, the bottom surface 83*a* of the support structure 83 is placed on the pad support surface 3*b* of the polishing table 3 while the first positioning protrusion 77 of the polishing-pad positioning instrument 80 is inserted into the drain hole 50B of the polishing table 3. Next, as shown in FIG. 20, the polishing-pad laminated structure 60 from which the first release sheet 62A has been peeled off is placed on the pad support surface 3*b* of the polishing table 3 and the support structure 83. At this time, as shown in FIG. 21, the second positioning protrusion 78 is inserted into the through-hole 51 of the polishing pad 1 and the through-hole 65 of the second release sheet 62B. The through-hole 51 of the polishing pad 1 is aligned with the sensor head 31 disposed in the polishing table 3 by the second positioning protrusion 78 inserted into the through-hole 51 of the polishing pad 1.

Figure 22:
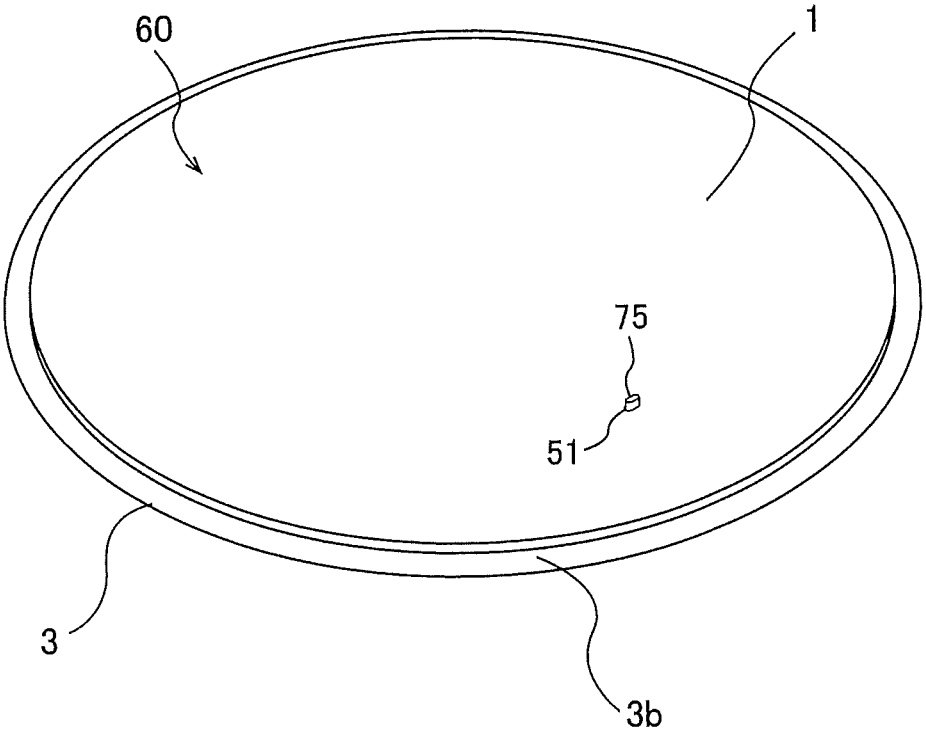
FIG. 22 is a view showing a process of attaching the polishing pad to the polishing table using the polishing-pad positioning instrument.

Next, the exposed portion (i.e., the portion that has been covered with the first release sheet 62A) of the adhesive surface 1*b* of the polishing pad 1 is attached to the pad support surface 3*b* of the polishing table 3. Thus, the relative position of the polishing-pad laminated structure 60 with respect to the polishing table 3 is fixed. The string 90 is pulled in a direction of an arrow shown in FIG. 20 to pull out the support structure 83 from the polishing table 3, thereby leaving the positioning structure 75 on the polishing table 3 as shown in FIG. 22. Next, the positioning structure 75 is removed from the polishing table 3 and the polishing pad 1. Further, the second release sheet 62B is peeled off from the polishing pad 1, and the entire adhesive surface 1*b* of the polishing pad 1 is attached to the pad support surface 3*b* of the polishing table 3.

Figure 23:
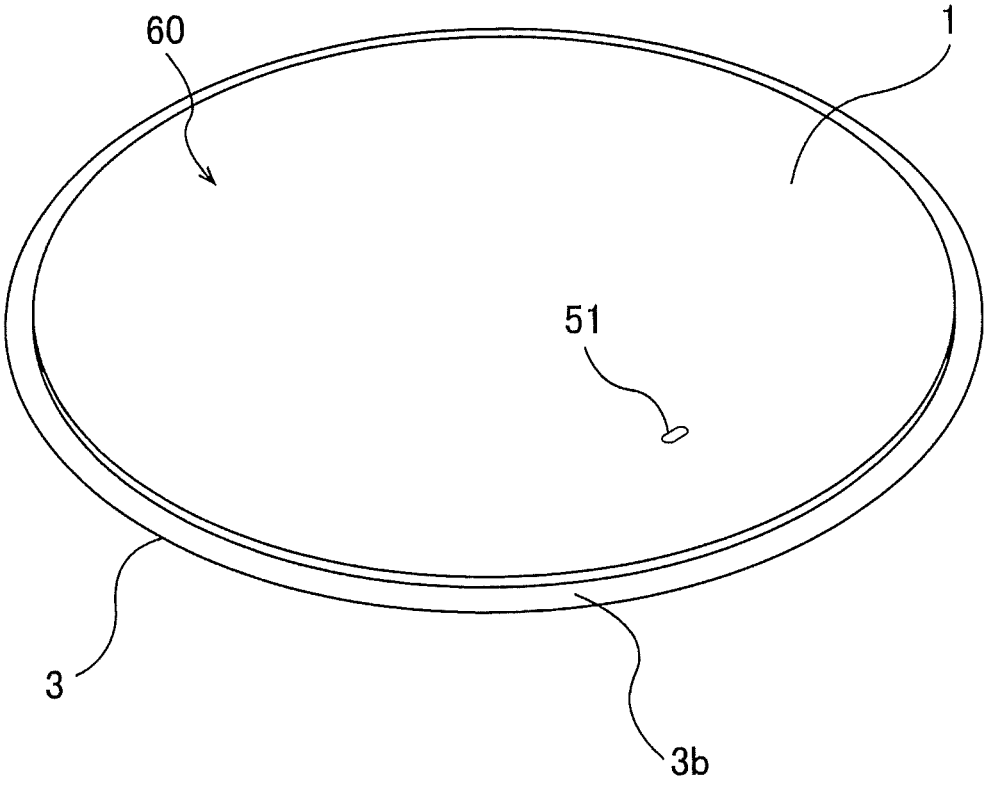
FIG. 23 is a view showing a process of attaching the polishing pad to the polishing table using the polishing-pad positioning instrument.
Figure 24:
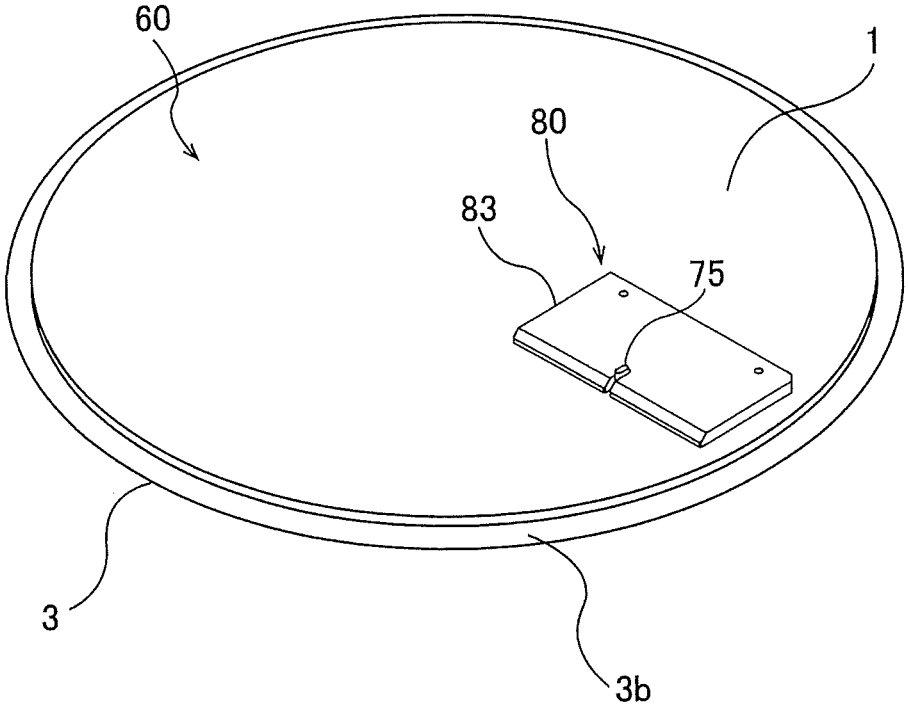
FIG. 24 is a view showing a process of attaching the polishing pad to the polishing table using the polishing-pad positioning instrument.
Figure 25:
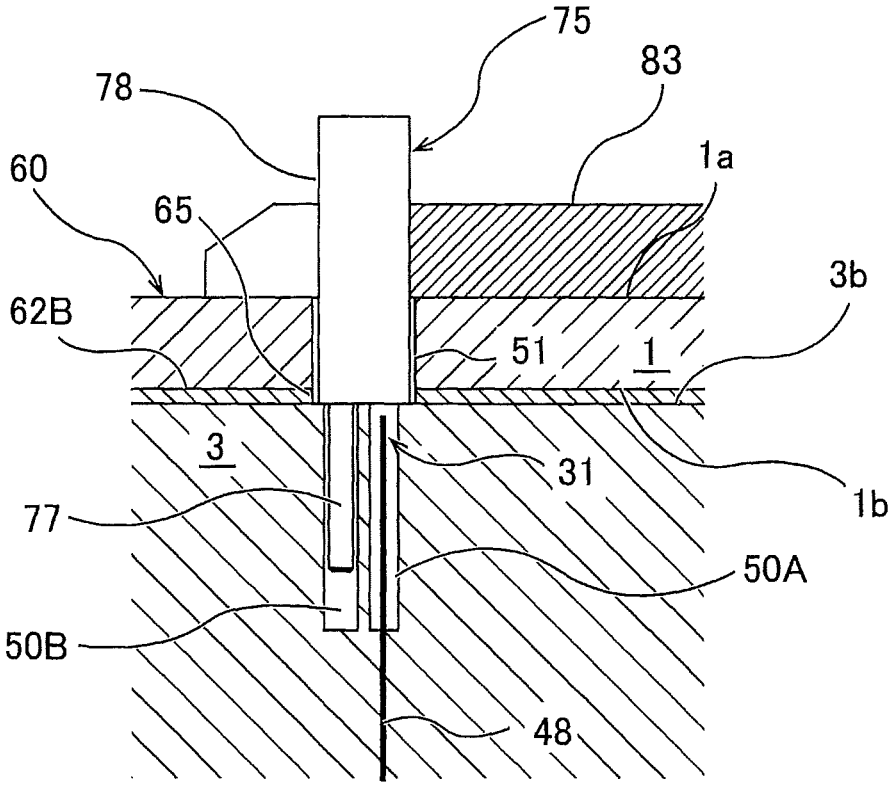
FIG. 25 is a cross-sectional view showing a positional relationship among the positioning structure, the polishing-pad laminated structure, and the polishing table.

In one embodiment, the polishing-pad positioning instrument 80 shown in FIGS. 18A and 18B may be used as follows. First, as shown in FIG. 23, the polishing-pad laminated structure 60 from which the first release sheet 62A has been removed is placed on the pad support surface 3*b* of the polishing table 3. Next, as shown in FIG. 24, the polishing-pad positioning instrument 80 is placed on the polishing pad 1. At this time, as shown in FIG. 25, the first positioning protrusion 77 is inserted into the drain hole 50B of the polishing table 3 through the through-hole 51 of the polishing pad 1 and the through-hole 65 of the second release sheet 62B. Further, the positioning protrusion 78 is inserted into the through-hole 51 of the polishing pad 1 and the through-hole 65 of the second release sheet 62B. The through-hole 51 of the polishing pad 1 is aligned with the sensor head 31 disposed in the polishing table 3 by the second positioning protrusion 78 inserted into the through-hole 51 of the polishing pad 1.

Next, while the polishing pad 1 is being pressed against the polishing table 3 by the support structure 83 of the polishing-pad positioning instrument 80, the exposed portion (i.e., the portion that has been covered with the first release sheet 62A) of the adhesive surface 1*b* of the polishing pad 1 is attached to the pad support surface 3*b* of the polishing table 3. Thus, the relative position of the polishing-pad laminated structure 60 with respect to the polishing table 3 is fixed. Thereafter, the polishing-pad positioning instrument 80 is removed from the polishing table 3. Further, the second release sheet 62B is peeled off from the polishing pad 1, and the entire adhesive surface 1*b* of the polishing pad 1 is attached to the pad support surface 3*b* of the polishing table 3.

Figure 26A:
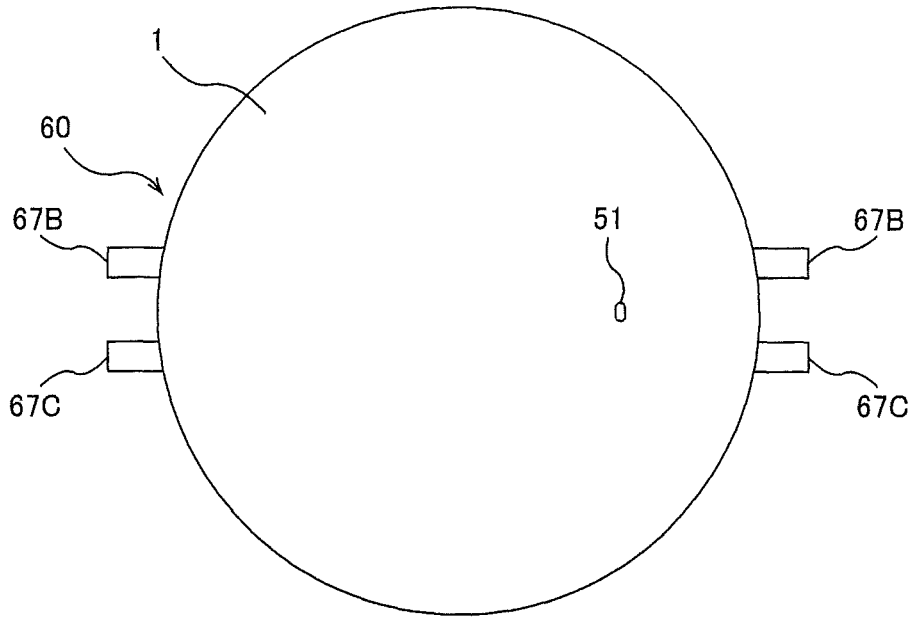
FIG. 26A is a top view showing another embodiment of a polishing-pad laminated structure.
Figure 26B:
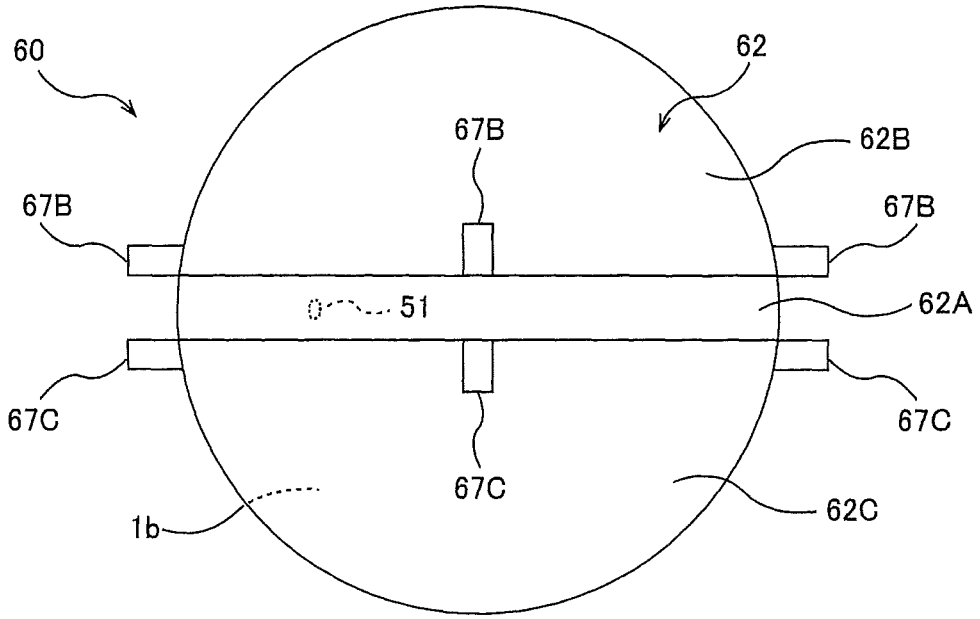
FIG. 26B is a backside view of the polishing-pad laminated structure shown in FIG. 26A.

FIG. 26A is a top view showing another embodiment of a polishing-pad laminated structure 60, and FIG. 26B is a backside view of the polishing-pad laminated structure 60 shown in FIG. 26A. Configurations, which are not particularly described, are the same as those of the embodiment described with reference to FIG. 4 to FIG. 6, and will not be described in duplication. In the present embodiment, a release sheet 62 is divided into a first release sheet 62A, a second release sheet 62B, and a third release sheet 62C. The first release sheet 62A is located at the center of the polishing pad 1 and extends from one side to the opposite side of the polishing pad 1. The second release sheet 62B and the third release sheet 62C are arranged to sandwich the first release sheet 62A. The first release sheet 62A has a band shape, and each of the second release sheet 62B and the third release sheet 62C has a half-moon shape. A surface area of the first release sheet 62A is smaller than a surface area of the second release sheet 62B and a surface area of the third release sheet 62C. In the present embodiment, the through-hole 51 of the polishing pad 1 are covered with the first release sheet 62A. No through-hole communicating with the through-hole 51 is formed in the release sheet 62 including the first release sheet 62A, the second release sheet 62B, and the third release sheet 62C. In one embodiment, a through-hole communicating with the through-hole 51 may be formed in the release sheet 62.

Three release assisting projections 67B are connected to the second release sheet 62B. One of the three release assisting projections 67B is connected to an inner edge of the second release sheet 62B, and the other two release assisting projections 67B are connected to both outer edges of the second release sheet 62B. It is noted, however, the arrangement of the release assisting projections 67B is not limited to the present embodiment. In one embodiment, only one or only two of the three release assisting projections 67B may be provided. In one embodiment, four or more release assisting projections 67B may be connected to the second release sheet 62B. A plurality of release assisting projections 67B may be connected to the inner edge of the second release sheet 62B, or three or more release assisting projections 67B may be connected to the outer edge of the second release sheet 62B. Further, in one embodiment, the release assisting projection 67B may not be provided.

Three release assisting projections 67C are connected to the third release sheet 62C. One of the three release assisting projections 67C is connected to an inner edge of the third release sheet 62C, and the other two release assisting projections 67C are connected to both outer edges of the third release sheet 62C. It is noted, however, the arrangement of the release assisting projections 67C is not limited to the present embodiment. In one embodiment, only one or only two of the three release assisting projections 67C may be provided. In one embodiment, four or more release assisting projections 67C may be connected to the third release sheet 62C. A plurality of release assisting projections 67C may be connected to the inner edge of the third release sheet 62C, or three or more release assisting projections 67C may be connected to the outer edge of the third release sheet 62C. Further, in one embodiment, the release assisting projection 67C may not be provided.

In the present embodiment, no release assisting projection is connected to the first release sheet 62A. However, a release assisting projection for assisting the removing of the first release sheet 62A may be connected to the first release sheet 62A.

Figure 7:
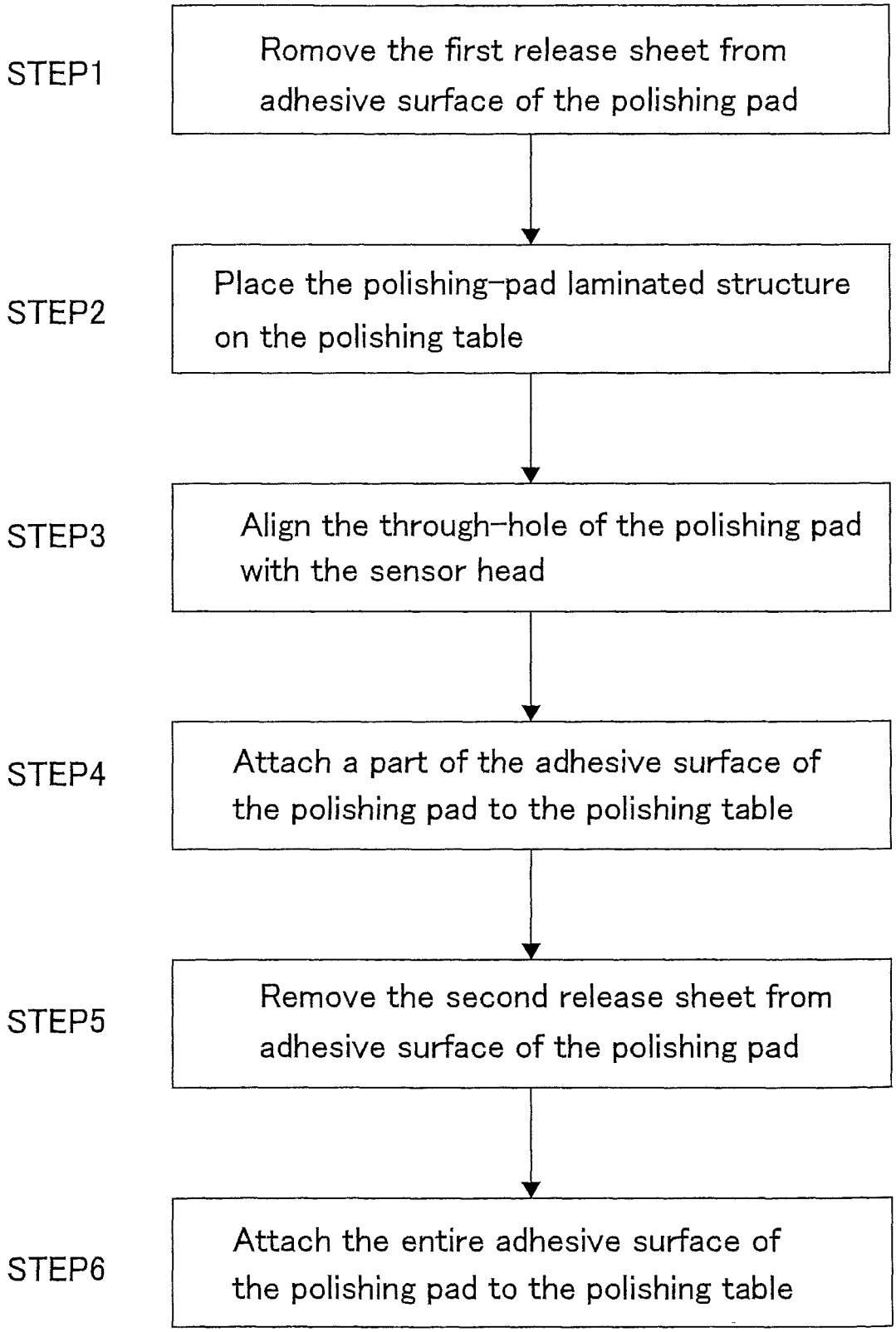
FIG. 7 is a flow chart for explaining an attaching operation of a polishing pad to a polishing table.

The attaching operation of the polishing pad 1 is performed in the same manner as the flowchart shown in FIG. 7. Specifically, a user peels off the first release sheet 62A from the adhesive surface 1*b* of the polishing pad 1. The polishing-pad laminated structure 60 is placed on the pad support surface 3*b* of the polishing table 3 with the second release sheet 62B and the third release sheet 62C covering the adhesive surface 1*b* of the polishing pad 1. Although the first release sheet 62A has been removed from the polishing pad 1, at this stage the exposed portion of the adhesive surface 1*b* of the polishing pad 1 (i.e., the portion that has been covered by the first release sheet 62A) does not adhere to the pad support surface 3*b* of the polishing table 3.

In this embodiment, the adhesive surface 1*b* is exposed around the through-hole 51 of the polishing pad 1. However, the exposed area of the adhesive surface 1*b* is small, and the exposed portion of the adhesive surface 1*b* is located between the second release sheet 62B and the third release sheet 62C. As a result, even when the polishing-pad laminated structure 60 is placed on the pad support surface 3*b* of the polishing table 3, the exposed portion of the adhesive surface 1*b* is not likely to contact the pad support surface 3*b*. Therefore, the polishing-pad laminated structure 60 can be freely moved on the polishing table 3.

Next, the through-hole 51 of the polishing pad 1 is aligned with the sensor head 31 disposed in the polishing table 3. As described above, since the polishing-pad laminated structure 60 can be freely moved on the polishing table 3, the through-hole 51 of the polishing pad 1 can be precisely aligned with the sensor head 31. With the through-hole 51 of the polishing pad 1 aligned with the sensor head 31, the exposed portion of the adhesive surface 1*b* of the polishing pad 1 is strongly pressed against the pad support surface 3*b* of the polishing table 3, whereby the portion of the adhesive surface 1*b* of the polishing pad 1 is attached to the pad support surface 3*b* of the polishing table 3. As a result, the relative position of the polishing-pad laminated structure 60 with respect to the polishing table 3 is fixed.

The user grips the release assisting projections 67B with fingers and peels off the second release sheet 62B from the adhesive surface 1*b* of the polishing pad 1. A new exposed portion of the adhesive surface 1*b* of the polishing pad 1 is strongly pressed against the pad support surface 3*b* of the polishing table 3. Further, the user grips the release assisting projections 67C with fingers, and peels off the third release sheet 62C from the adhesive surface 1*b* of the polishing pad 1. Then, the remaining part of the adhesive surface 1*b* of the polishing pad 1 is strongly pressed against the pad support surface 3*b* of the polishing table 3, whereby the entire adhesive surface 1*b* of the polishing pad 1 is attached to the pad support surface 3*b* of the polishing table 3. In one embodiment, the third release sheet 62C may be removed from the adhesive surface 1*b* of the polishing pad 1, and then the second release sheet 62B may be removed from the adhesive surface 1*b* of the polishing pad 1.

Figure 27A:
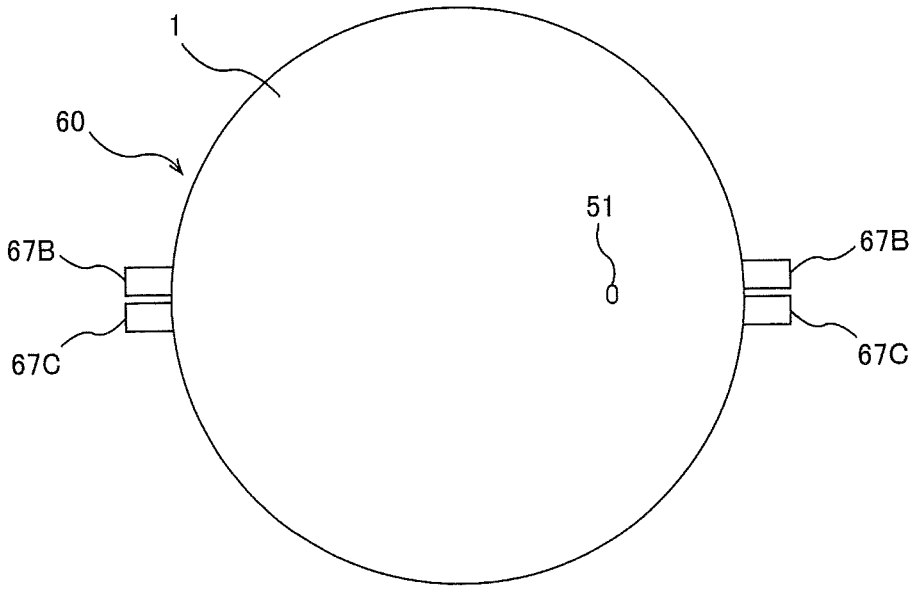
FIG. 27A is a top view showing still another embodiment of a polishing-pad laminated structure.
Figure 27B:
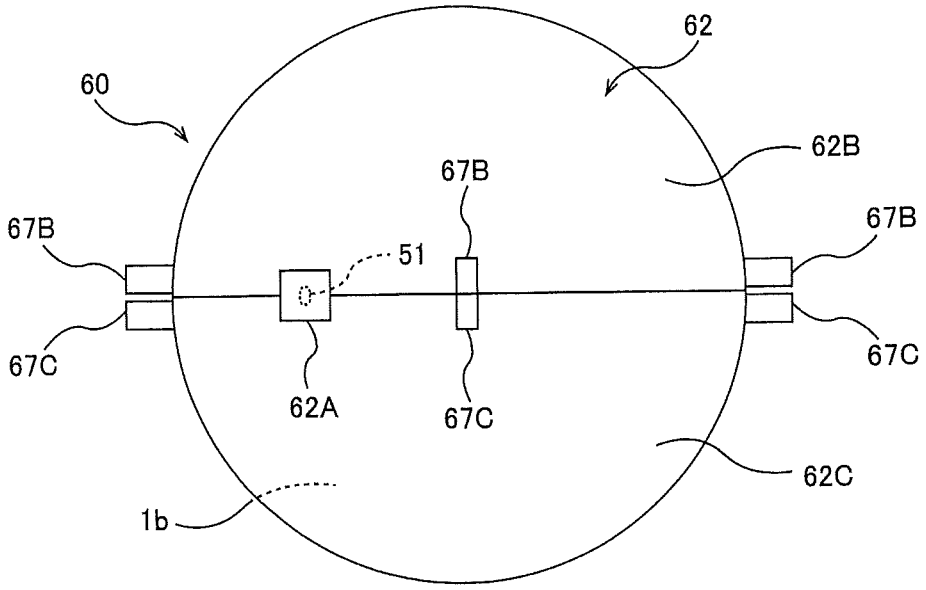
FIG. 27B is a backside view of the polishing-pad laminated structure shown in FIG. 27A.

FIG. 27A is a top view showing still another embodiment of a polishing-pad laminated structure 60, and FIG. 27B is a backside view of the polishing-pad laminated structure 60 shown in FIG. 27A. Configurations, which are not particularly described, are the same as those of the embodiment described with reference to FIG. 4 to FIG. 6, and will not be described in duplication. A release sheet 62 is divided into a first release sheet 62A, a second release sheet 62B, and a third release sheet 62C. In the present embodiment, the through-hole 51 of the polishing pad 1 are covered with the first release sheet 62A. No through-hole communicating with the through-hole 51 is formed in the release sheet 62 including the first release sheet 62A, the second release sheet 62B, and the third release sheet 62C. In one embodiment, a through-hole communicating with the through-hole 51 may be formed in the release sheet 62.

The first release sheet 62A has a rectangular shape. The entire first release sheet 62A is surrounded by the second release sheet 62B and the third release sheet 62C. Each of the second release sheet 62B and the third release sheet 62C has a half-moon shape. A surface area of the first release sheet 62A is smaller than a surface area of the second release sheet 62B and a surface area of the third release sheet 62C.

Three release assisting projections 67B are connected to the second release sheet 62B. One of the three release assisting projections 67B is connected to an inner edge of the second release sheet 62B, and the other two release assisting projections 67B are connected to both outer edges of the second release sheet 62B. It is noted, however, the arrangement of the release assisting projections 67B is not limited to the present embodiment. In one embodiment, only one or only two of the three release assisting projections 67B may be provided. In one embodiment, four or more release assisting projections 67B may be connected to the second release sheet 62B. A plurality of release assisting projections 67B may be connected to the inner edge of the second release sheet 62B, or three or more release assisting projections 67B may be connected to the outer edge of the second release sheet 62B. Further, in one embodiment, the release assisting projection 67B may not be provided.

Three release assisting projections 67C are connected to the third release sheet 62C. One of the three release assisting projections 67C is connected to an inner edge of the third release sheet 62C, and the other two release assisting projections 67C are connected to both outer edges of the third release sheet 62C. It is noted, however, the arrangement of the release assisting projections 67C is not limited to the present embodiment. In one embodiment, only one or only two of the three release assisting projections 67C may be provided. In one embodiment, four or more release assisting projections 67C may be connected to the third release sheet 62C. A plurality of release assisting projections 67C may be connected to the inner edge of the third release sheet 62C, or three or more release assisting projections 67C may be connected to the outer edge of the third release sheet 62C. Further, in one embodiment, the release assisting projection 67C may not be provided.

In the present embodiment, no release assisting projection is connected to the first release sheet 62A. However, a release assisting projection for assisting the removing of the first release sheet 62A may be connected to the first peeling sheet 62A.

The attaching operation of the polishing pad 1 is performed in the same manner as the embodiment shown in FIGS. 26A and 26B, and thus repetitive descriptions thereof will not be omitted.

Also in this embodiment, the adhesive surface 1*b* is exposed around the through-hole 51 of the polishing pad 1, but the exposed area of the adhesive surface 1*b* is small, and the entire exposed portion of the adhesive surface 1*b* is surrounded by the second release sheet 62B and the third release sheet 62C. As a result, when the polishing-pad laminated structure 60 is placed on the pad support surface 3*b* of the polishing table 3, the exposed portion of the adhesive surface 1*b* is not likely to contact the pad support surface 3*b*. Therefore, the polishing-pad laminated structure 60 can be freely moved on the polishing table 3.

The positioning structure 75 as the polishing-pad positioning instrument shown in FIGS. 8A and 8B, the polishing-pad positioning instrument 80 shown in FIG. 12, and the polishing-pad positioning instrument 80 shown in FIGS. 18A and 18B can be used to attach the polishing pad 1 shown in FIG. 26A and FIG. 26B and the polishing pad 1 shown in FIG. 27A and FIG. 27B to the polishing pad 3.

Figure 28:
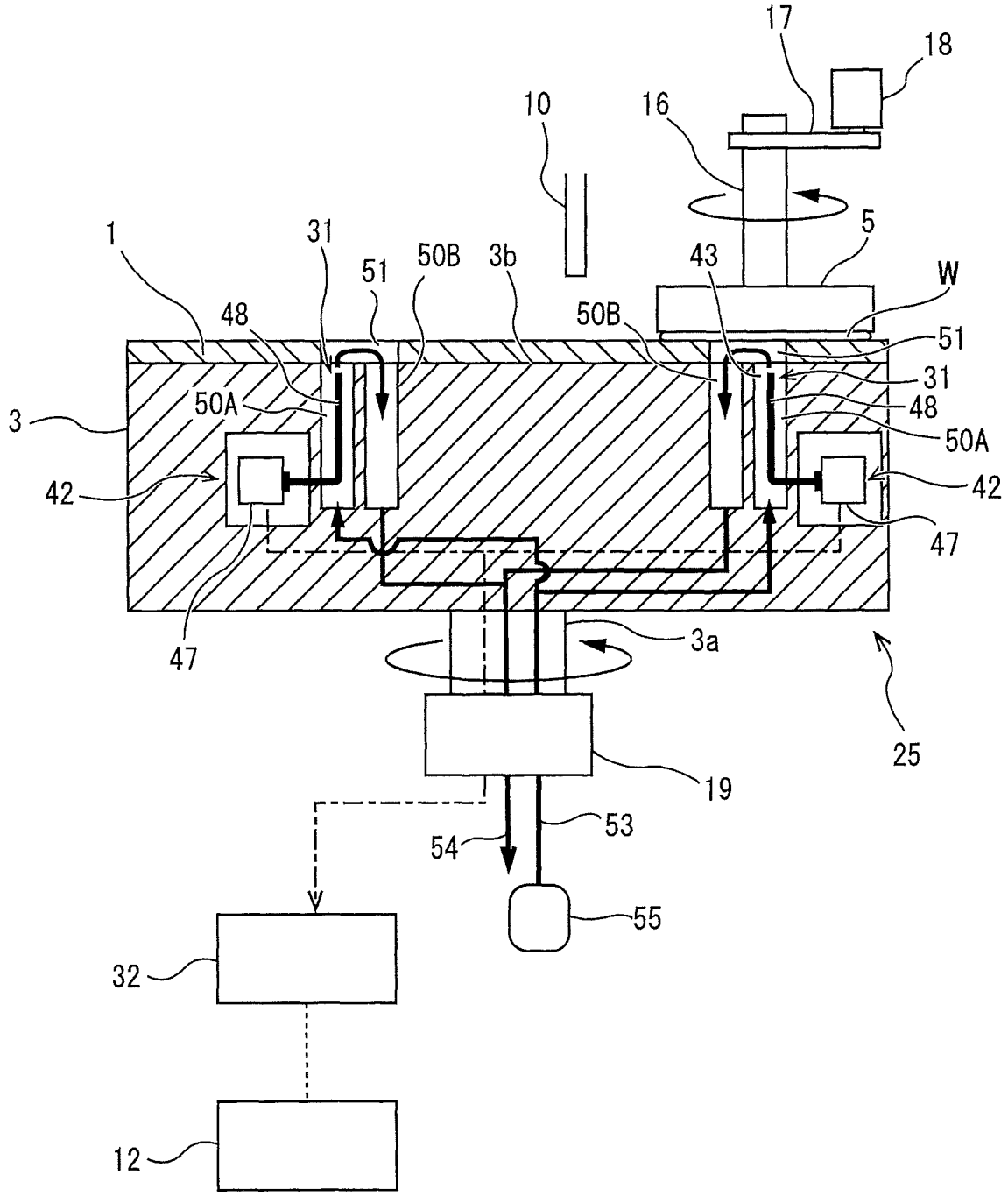
FIG. 28 is a schematic cross-sectional view showing an embodiment of a polishing apparatus having a polishing table in which a plurality of sensor heads are arranged.

Although only one sensor head 31 is provided in the polishing table 3 in the embodiments described above, the present invention can be applied to a polishing apparatus including a polishing table 3 in which a plurality of sensor heads 31 are disposed as shown in FIG. 28. Two sensor heads 31 are arranged in the embodiment shown in FIG. 28, while the polishing apparatus may include three or more sensor heads 31, and the polishing pad 1 may have three or more through-holes 51.

Figure 29A:
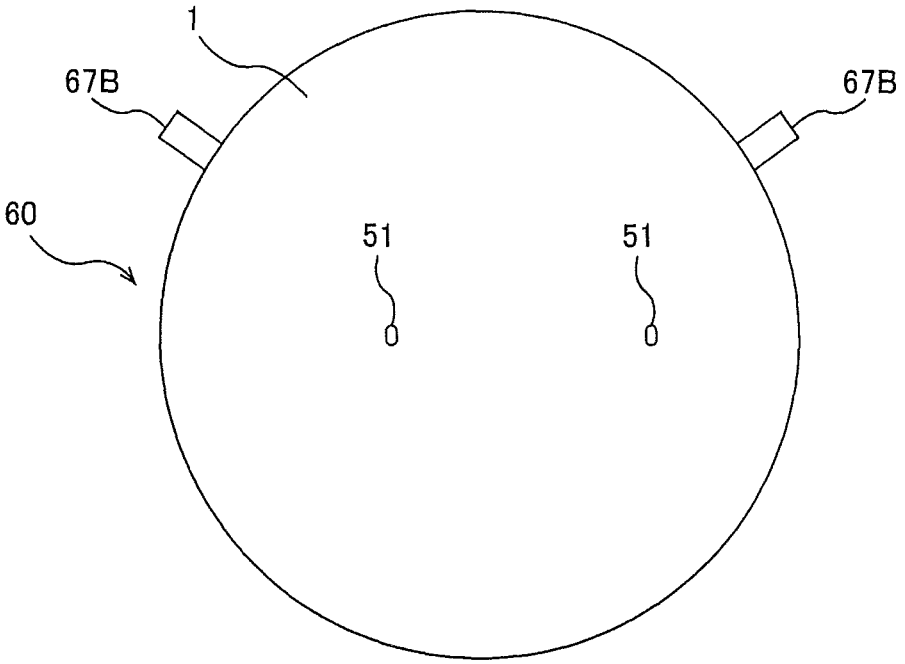
FIG. 29A is a top view showing an embodiment of a polishing-pad laminated structure used for the polishing table in which two sensor heads are arranged.
Figure 29B:
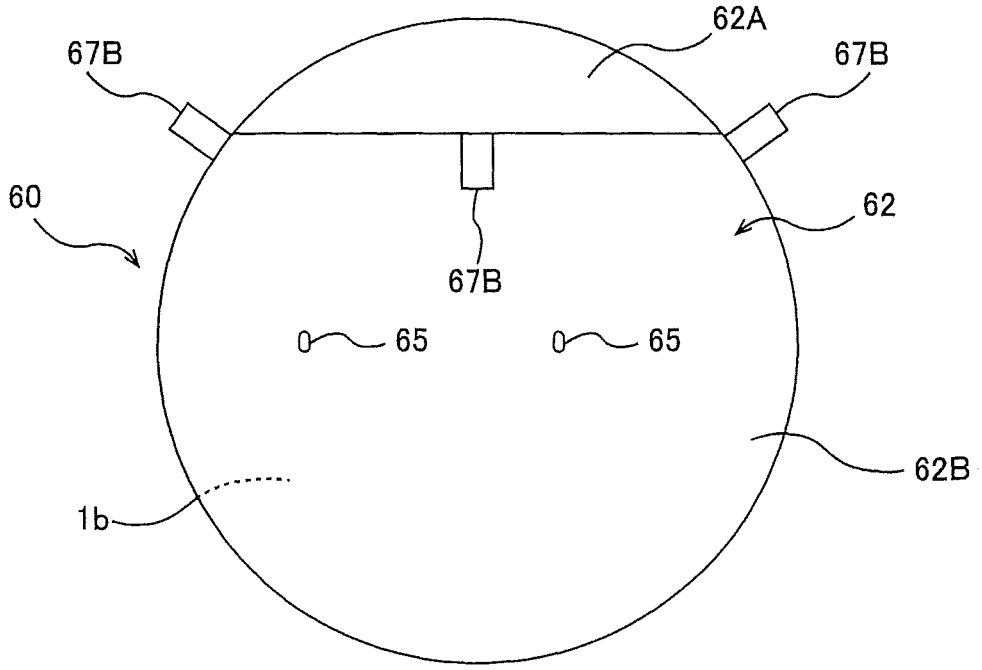
FIG. 29B is a backside view of the polishing-pad laminated structure shown in FIG. 29A.

FIG. 29A is a top view showing an embodiment of a polishing-pad laminated structure 60 used for the polishing table 3 in which two sensor heads 31 are disposed, and FIG. 29B is a top view of the polishing-pad laminated structure 60 shown in FIG. 29A. Configurations, which are not particularly described, are the same as those of the embodiment described with reference to FIG. 4 to FIG. 6, and will not be described in duplication. As shown in FIG. 29A, a polishing pad 1 has two through-holes 51 corresponding to the two sensor heads 31. Positions of these two through-holes 51 correspond to positions of the two sensor heads 31 in the polishing table 3. Further, as shown in FIG. 29B, a release sheet 62 has two through-holes 65 at the same positions as those of the through-holes 51 of the polishing pad 1.

The attaching operation of the polishing pad 1 shown in FIG. 29A is performed using a polishing-pad positioning instrument including two positioning structures 75. More specifically, the attaching operation of the polishing pad 1 shown in FIG. 29A is carried out in the same manner as the embodiment described with reference to the flowchart shown in FIG. 7, or the embodiment described with reference to FIGS. 10 to 11B, or the embodiment described with reference to FIGS. 15 to 17, or the embodiment described with reference to FIGS. 19A to 22, or the embodiment described with reference to FIGS. 23 to 25.

Figure 30:
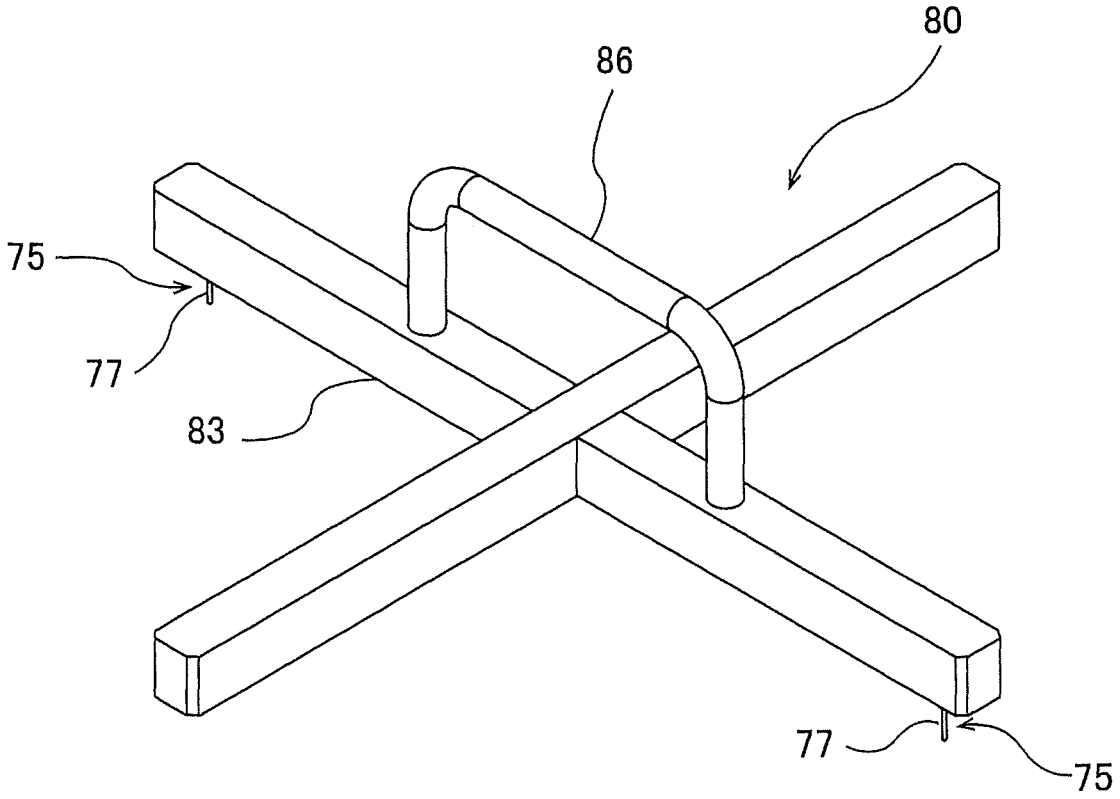
FIG. 30 is a perspective view showing an embodiment of a polishing-pad positioning instrument suitable for the polishing-pad laminated structure shown in FIGS. 29A and 29B.
Figure 31:
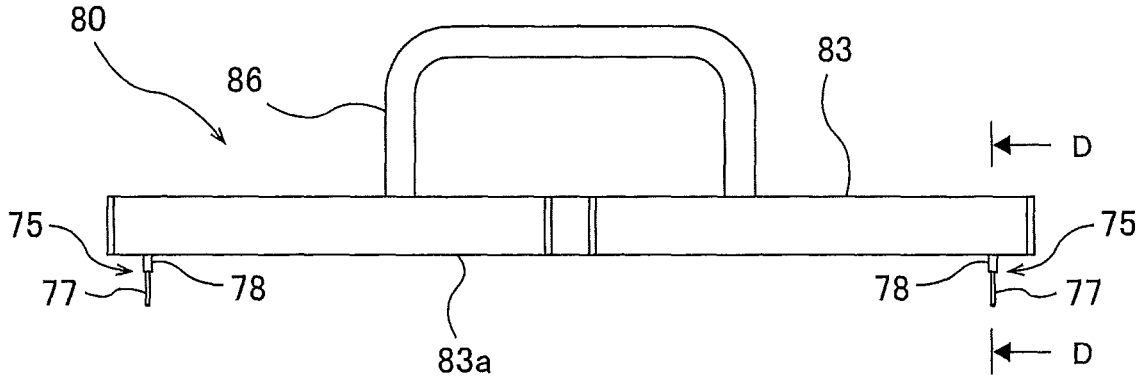
FIG. 31 is a front view of the polishing-pad positioning instrument shown in FIG. 30.
Figure 32:
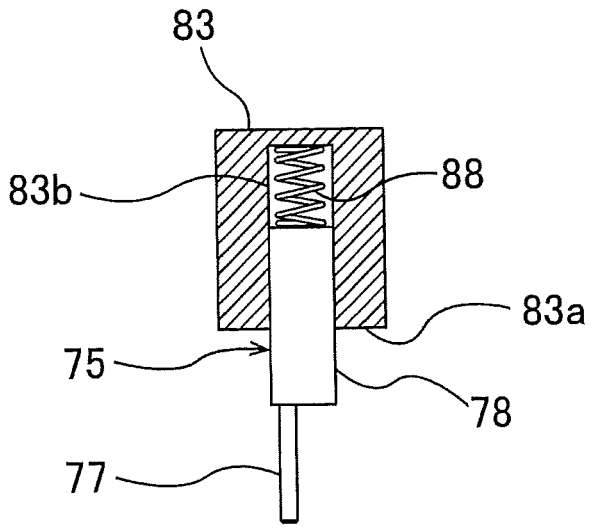
FIG. 32 is a cross-sectional view taken along a line D-D of FIG. 31.

FIG. 30 is a perspective view showing an embodiment of a polishing-pad positioning instrument 80 suitable for the polishing-pad laminated structure 60 shown in FIGS. 29A and 29B, FIG. 31 is a front view of the polishing-pad positioning instrument 80 shown in FIG. 30, and FIG. 32 is a cross-sectional view taken along a line D-D of FIG. 31. Configurations of the present embodiment, which are not particularly described, are the same as those of the embodiment described with reference to FIGS. 12 to 14, and thus repetitive descriptions will be omitted.

The polishing-pad positioning instrument 80 of the present embodiment includes two positioning structures 75. The positions of these positioning structures 75 correspond to the positions of the two sensor heads 31 installed in the polishing table 3. The method of using the polishing-pad positioning instrument 80 according to the present embodiment is the same as the embodiment described with reference to FIGS. 15 to 17, and thus repetitive descriptions will be omitted.

Figure 33A:
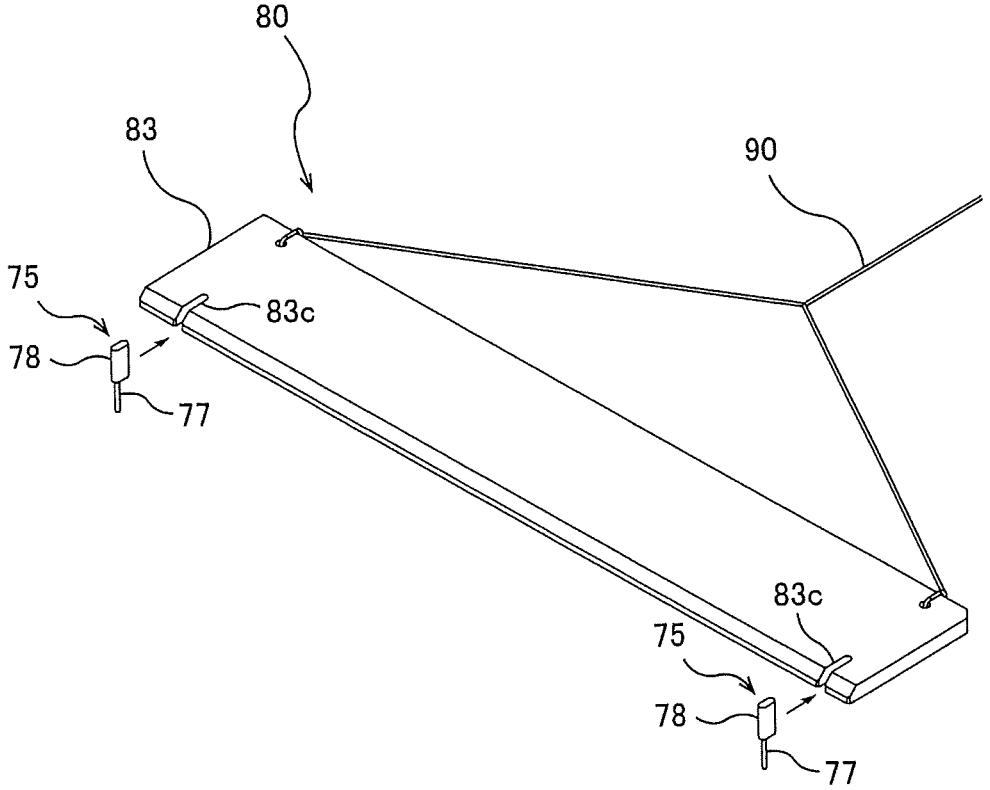
FIGS. 33A and 33B are perspective views each showing another embodiment of a polishing-pad positioning instrument suitable for the polishing-pad laminated structure shown in FIGS. 29A and 29B.
Figure 33B:
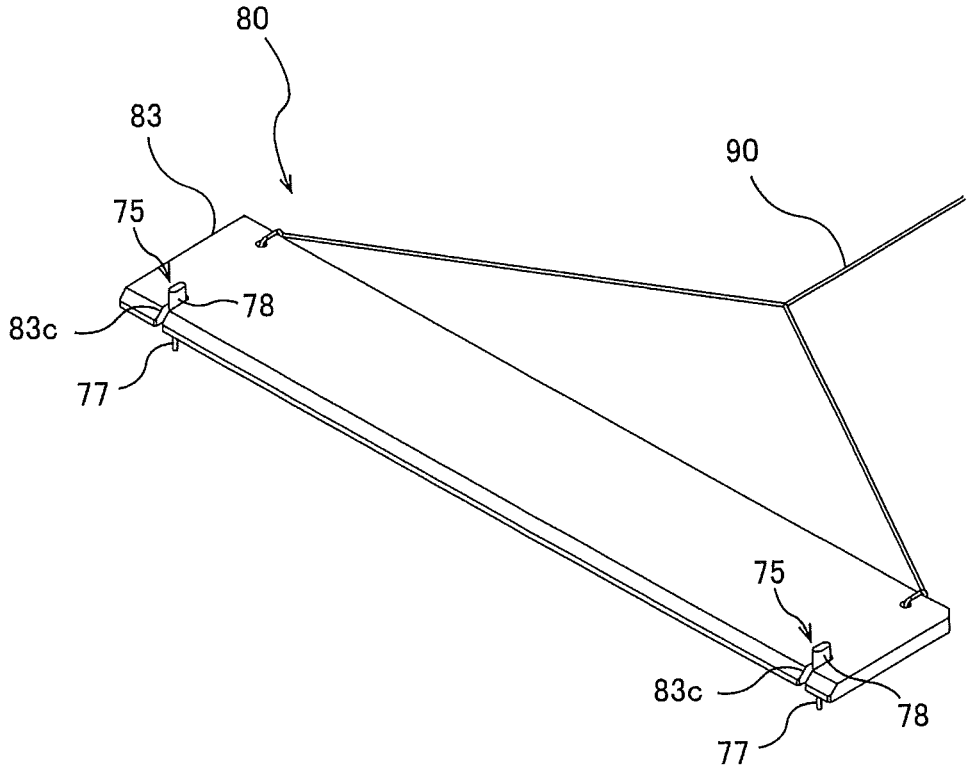

FIGS. 33A and 33B are perspective views each showing another embodiment of a polishing-pad positioning instrument 80 suitable for the polishing-pad laminated structure 60 shown in FIGS. 29A and 29B. Configurations of the present embodiment, which are not particularly described, are the same as those of the embodiment described with reference to FIGS. 18A and 18B, and thus repetitive descriptions will be omitted.

The polishing-pad positioning instrument 80 of the present embodiment includes two positioning structures 75 detachably attached to a support structure 83. More specifically, two slits 83*c*, with which the second positioning protrusions 78 of the positioning structures 75 engage, are formed in one edge of the support structure 83. The second positioning protrusions 78 of the respective positioning structures 75 are slid into the slits 83*c*, so that the two positioning structures 75 are attached to the support structure 83, as shown in FIG. 33B. The method of using the polishing-pad positioning instrument 80 according to the present embodiment is the same as the embodiment described with reference to FIGS. 19A to 22 or the embodiment described with reference to FIGS. 23 to 25, and thus repetitive descriptions will be omitted.

Figure 34:
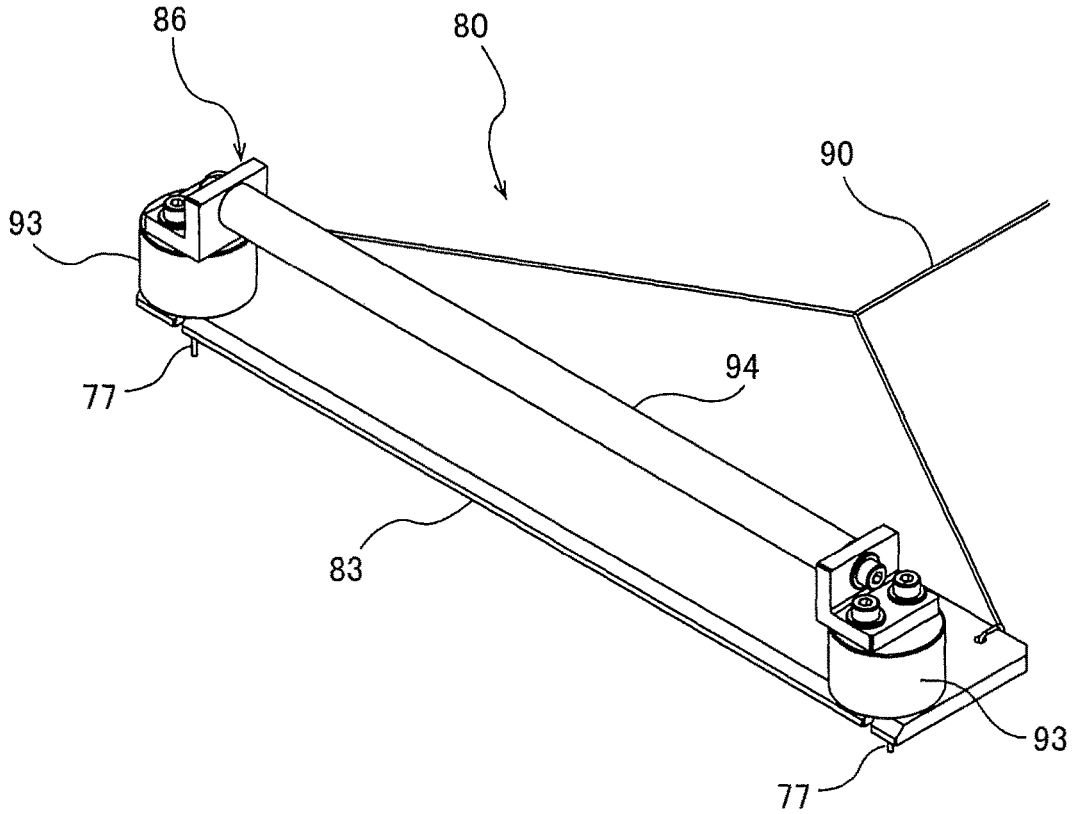
FIG. 34 is a perspective view showing another embodiment of a polishing-pad positioning instrument suitable for the polishing-pad laminated structure shown in FIGS. 29A and 29B.
Figure 35:
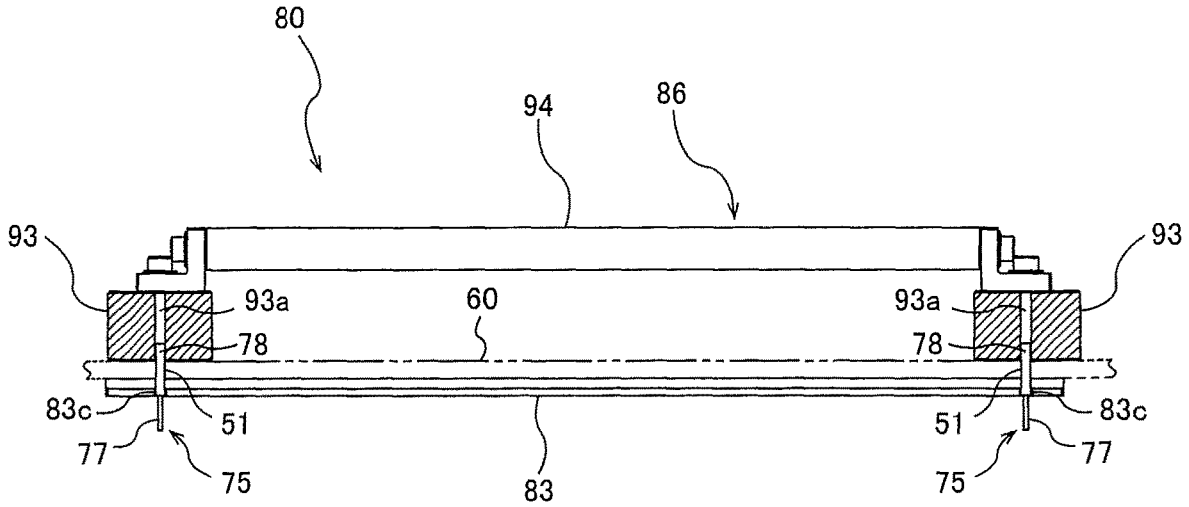
FIG. 35 is a front view of the polishing-pad positioning instrument shown in FIG. 34.

FIG. 34 is a perspective view showing another embodiment of a polishing-pad positioning instrument 80 suitable for the polishing-pad laminated structure 60 shown in FIGS. 29A and 29B, and FIG. 35 is a front view of the polishing-pad positioning instrument 80 shown in FIG. 34. Configurations of the present embodiment, which are not particularly described, are the same as those of the embodiment described with reference to FIGS. 33A and 33B, and thus repetitive descriptions will be omitted.

The polishing-pad positioning instrument 80 of the present embodiment has a handle 86. This handle 86 includes two pedestals 93 for supporting the second positioning protrusions 78 of the two positioning structures 75, respectively, and a rod 94 extending between the pedestals 93. Both ends of the rod 94 are fixed to the two pedestals 93, respectively. Each pedestal 93 has a vertical hole 93*a* extending perpendicularly to a bottom surface thereof, so that the corresponding second positioning protrusion 78 can be fitted into the vertical hole 93*a*. As shown in FIG. 35, the handle 86 is placed on the polishing-pad laminated structure 60. The upper portions of the second positioning protrusions 78, extending through the through-holes 51 of the polishing-pad laminated structure 60, are inserted into the vertical holes 93*a* of the pedestals 93, respectively.

Figure 36A:
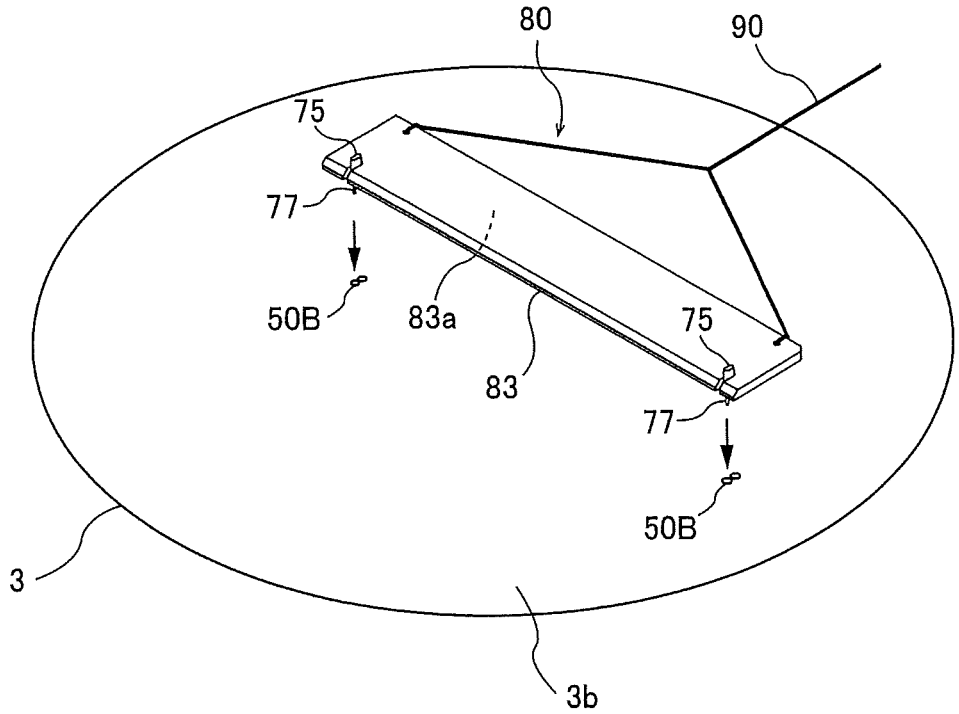
FIGS. 36A and 36B are diagrams each showing a process of attaching a polishing pad to a polishing table using the polishing-pad positioning instrument.
Figure 36B:
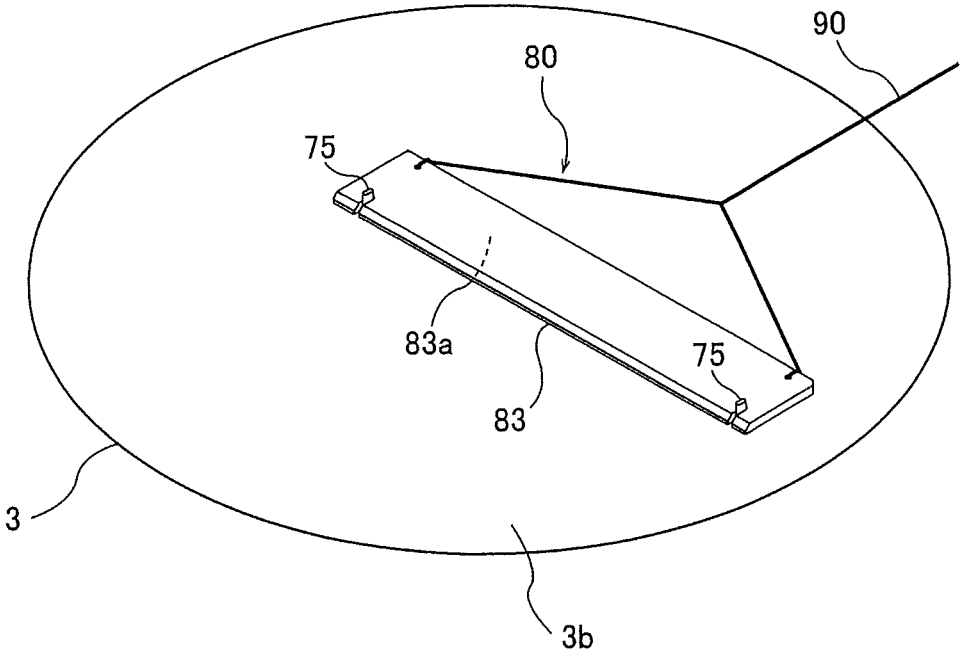
Figure 37:
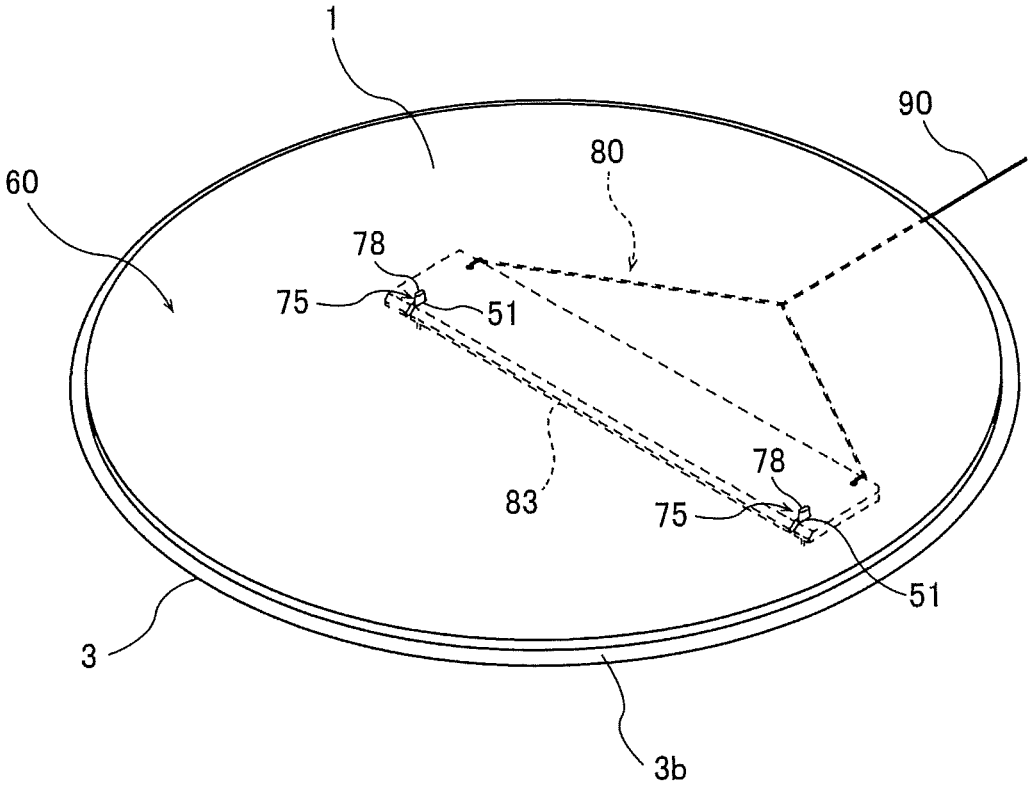
FIG. 37 is a view showing a process of attaching the polishing pad to the polishing table using the polishing-pad positioning instrument.

The polishing-pad positioning instrument 80 shown in FIG. 34 is used as follows. First, as shown in FIGS. 36A and 36B, the bottom 83*a* of the support structure 83 is placed on the pad support surface 3*b* of the polishing table 3 while the first positioning protrusions 77 of the polishing-pad positioning instrument 80 are inserted into the drain holes 50B of the polishing table 3. Next, as shown in FIG. 37, the polishing-pad laminated structure 60 from which the first release sheet 62A has been peeled off is placed on the pad support surface 3*b* of the polishing table 3 and the support structure 83. At this time, the second positioning protrusions 78 are inserted into the through-holes 51 of the polishing pad 1 and the through-holes 65 of the second release sheet 62B (see FIG. 21). The through-holes 51 of the polishing pad 1 are aligned with the sensor heads 31, respectively, disposed in the polishing table 3 by the second positioning protrusions 78 inserted into the through-holes 51 of the polishing pad 1.

Figure 38:
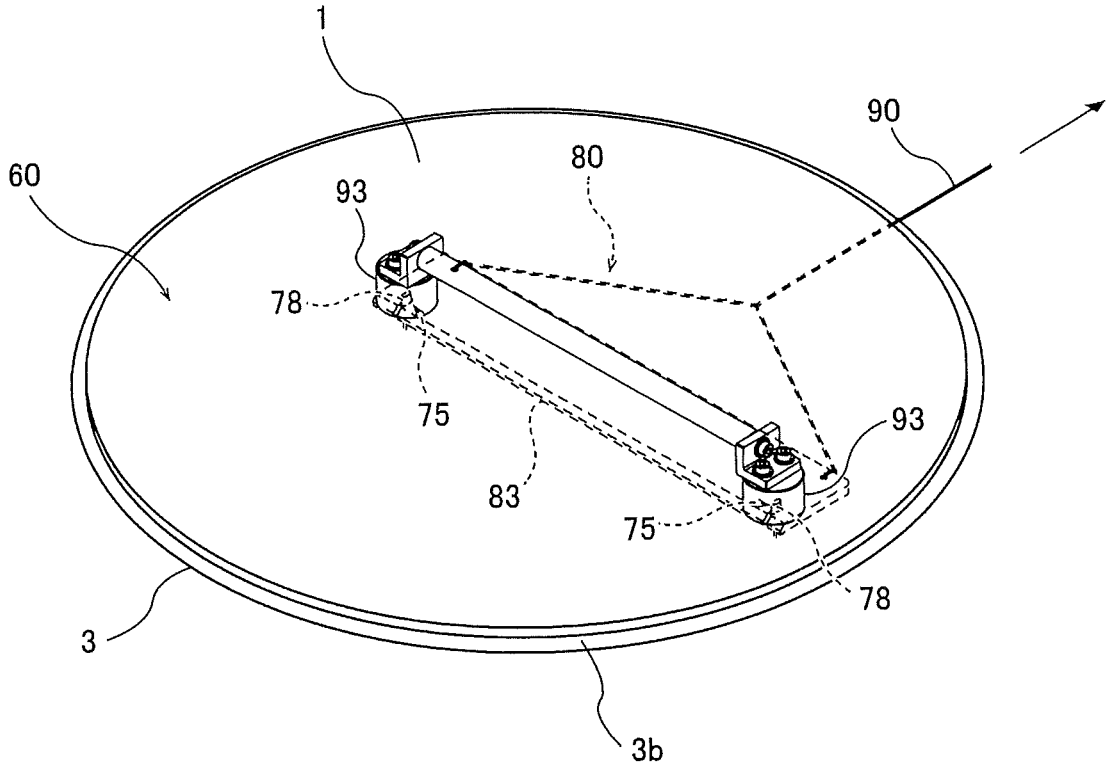
FIG. 38 is a view showing a process of attaching the polishing pad to the polishing table using the polishing-pad positioning instrument.

The exposed portion (i.e., the portion that has been covered with the first release sheet 62A) of the adhesive surface 1*b* of the polishing pad 1 is attached to the pad support surface 3*b* of the polishing table 3. Thus, the relative position of the polishing-pad laminated structure 60 with respect to the polishing table 3 is fixed. As shown in FIG. 38, the handle 86 is attached to the positioning structures 75. More specifically, the second positioning protrusions 78, protruding upward from the polishing-pad laminated structure 60, are inserted into the vertical holes 93*a* (see FIG. 35) of the pedestals 93. While the handle 86 is being pressed against the polishing-pad laminated structure 60 so that the positioning structures 75 do not fall down, the support structure 83 is pulled out of the polishing table 3 by pulling the string 90 in the direction of the arrow shown in FIG. 38. Next, the handle 86 and the positioning structures 75 are removed from the polishing-pad laminated structure 60. Furthermore, the second release sheet 62B is peeled off from the polishing pad 1, and the entire adhesive surface 1*b* of the polishing pad 1 is attached to the pad support surface 3*b* of the polishing table 3.

Figure 39A:
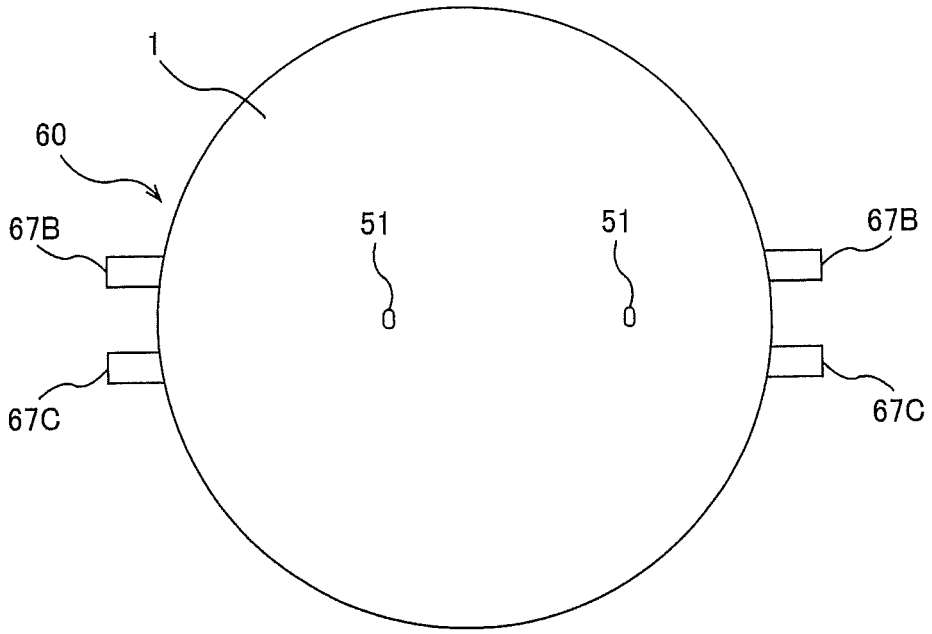
FIG. 39A is a top view showing another embodiment of a polishing-pad laminated structure used for a polishing table in which two sensor heads are arranged.
Figure 39B:
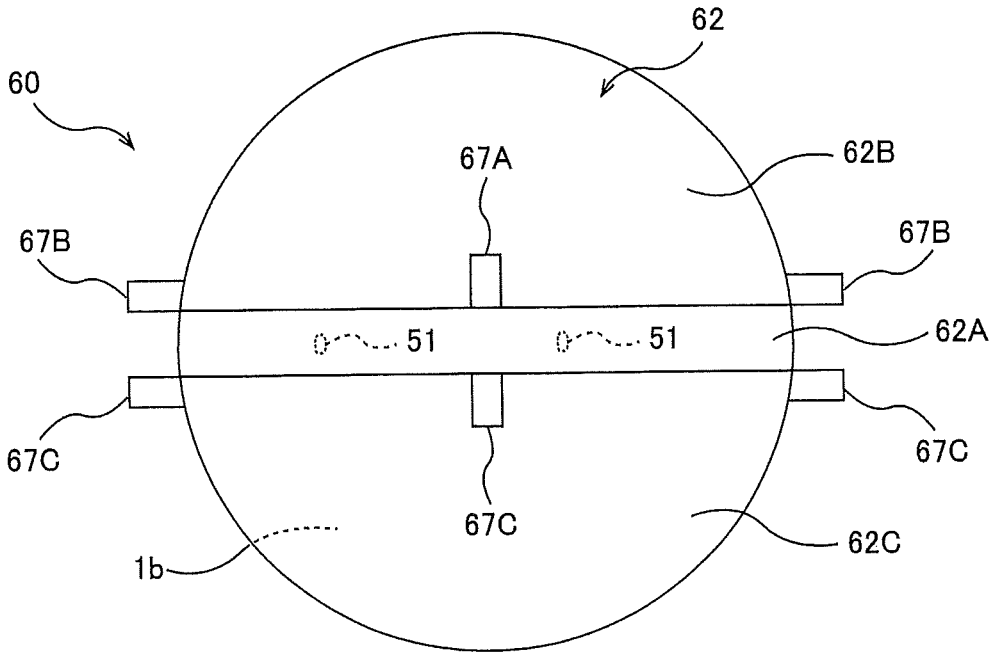
FIG. 39B is a backside view of the polishing-pad laminated structure shown in FIG. 39A.

FIG. 39A is a top view showing another embodiment of a polishing-pad laminated structure 60 used for the polishing table 3 in which the two sensor heads 31 are arranged, and FIG. 39B is a backside view of the polishing-pad laminated structure 60 shown in FIG. 39A. Configurations, which are not particularly described, are the same as those of the embodiment described with reference to FIGS. 26A and 26B, and thus the description thereof will not be repeated. As shown in FIG. 39A, a polishing pad 1 has two through-holes 51 corresponding to the two sensor heads 31. The positions of these two through-holes 51 correspond to the positions of the two sensor heads 31 in the polishing table 3. As shown in FIG. 39B, a release sheet 62 is divided into a first release sheet 62A, a second release sheet 62B, and a third release sheet 62C.

Figure 40A:
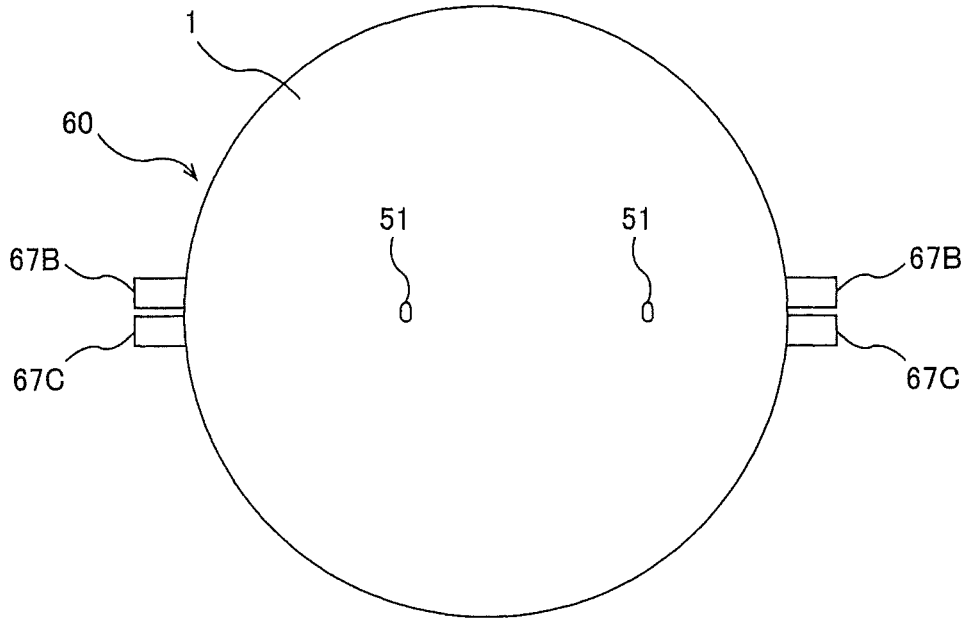
FIG. 40A is a top view showing still another embodiment of a polishing-pad laminated structure used for a polishing table in which two sensor heads are arranged.
Figure 40B:
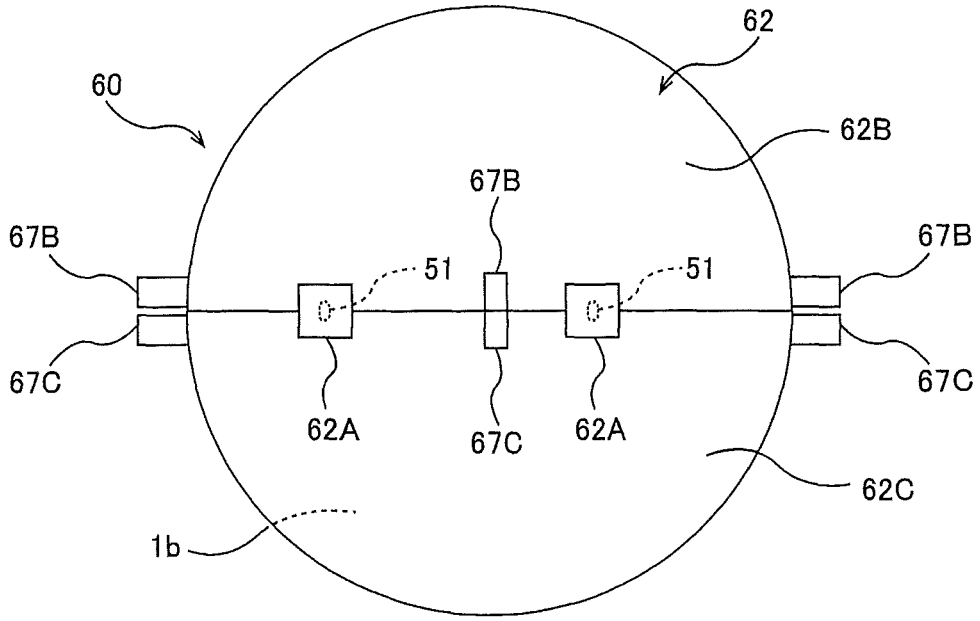
FIG. 40B is a backside view of the polishing-pad laminated structure shown in FIG. 40A.
Figure 41A:
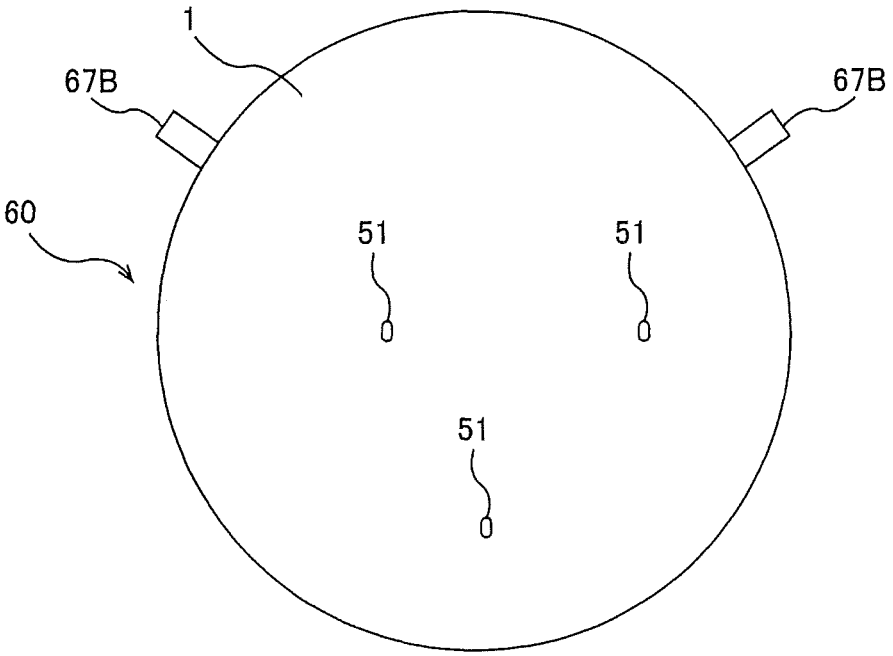
FIG. 41A is a top view showing an embodiment of a polishing-pad laminated structure used for a polishing table in which three sensor heads are arranged.
Figure 41B:
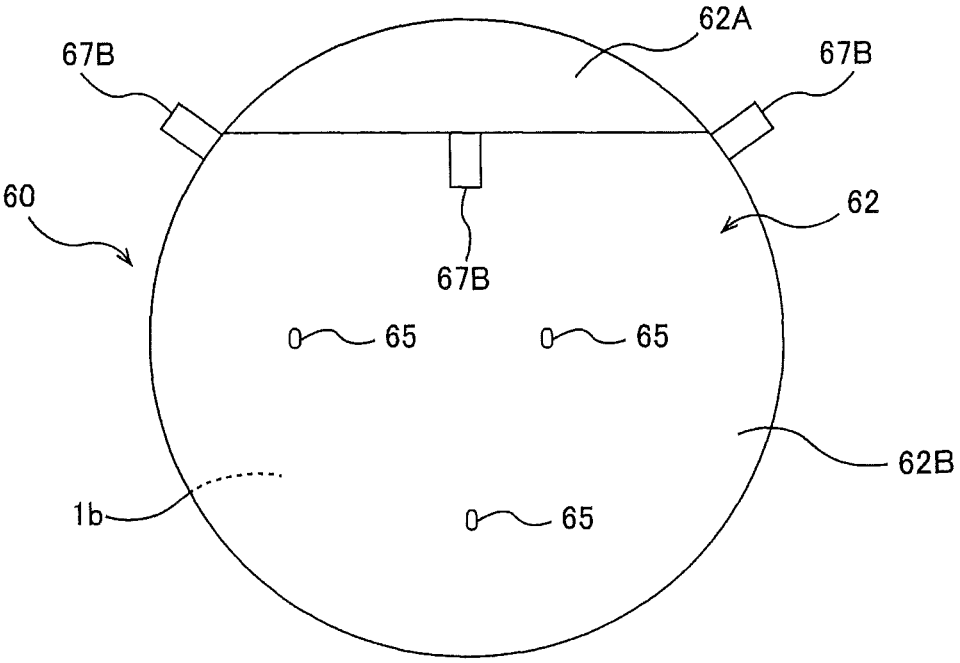
FIG. 41B is a backside view of the polishing-pad laminated structure shown in FIG. 41A.
Figure 42A:
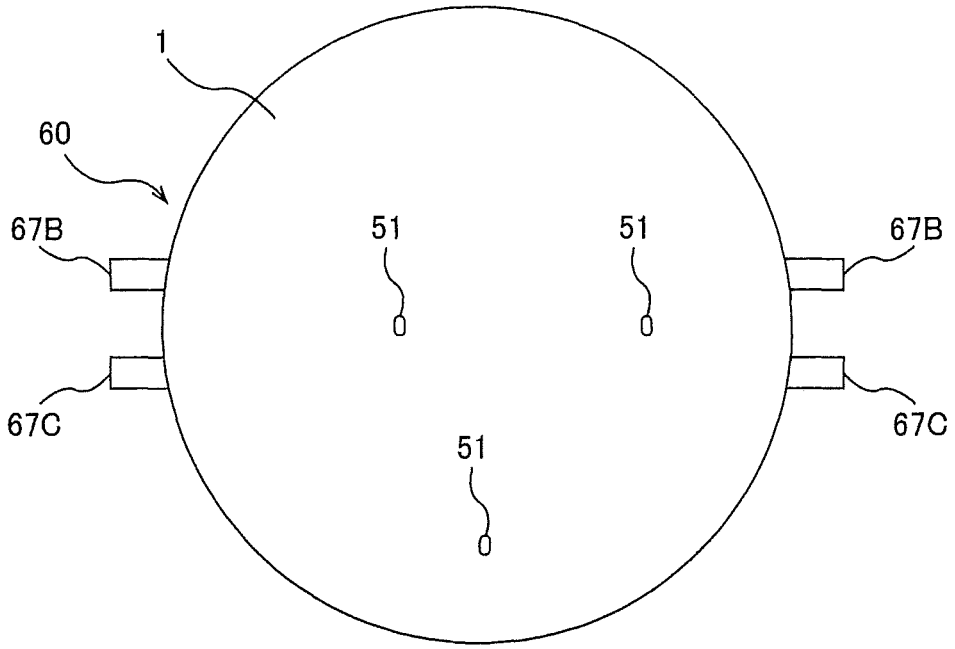
FIG. 42A is a top view showing another embodiment of a polishing-pad laminated structure used for a polishing table in which three sensor heads are arranged.
Figure 42B:
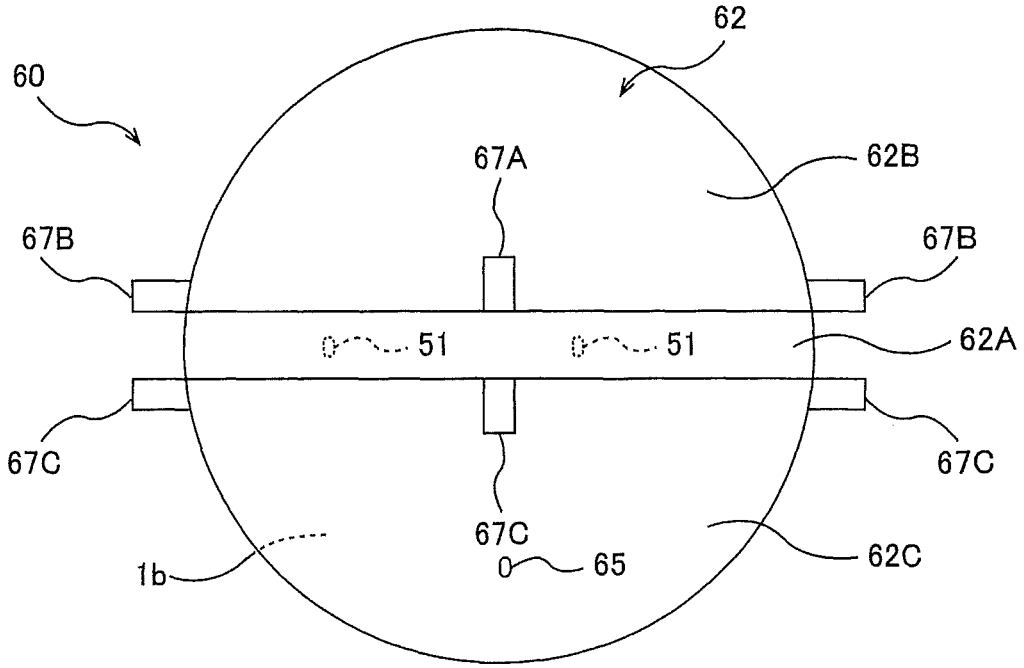
FIG. 42B is a backside view of the polishing-pad laminated structure shown in FIG. 42A.
Figure 43A:
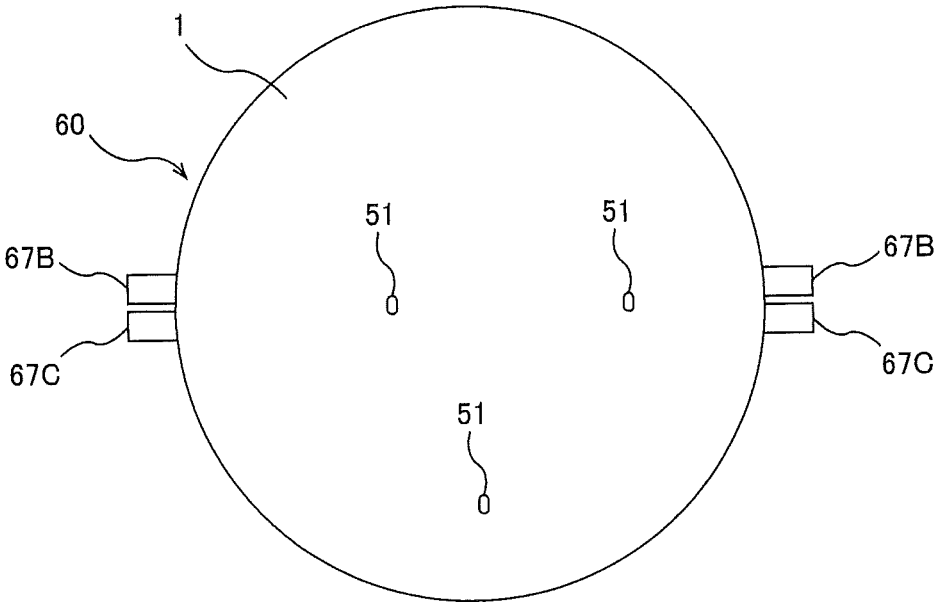
FIG. 43A is a top view showing still another embodiment of a polishing-pad laminated structure used for a polishing table in which three sensor heads are arranged.
Figure 43B:
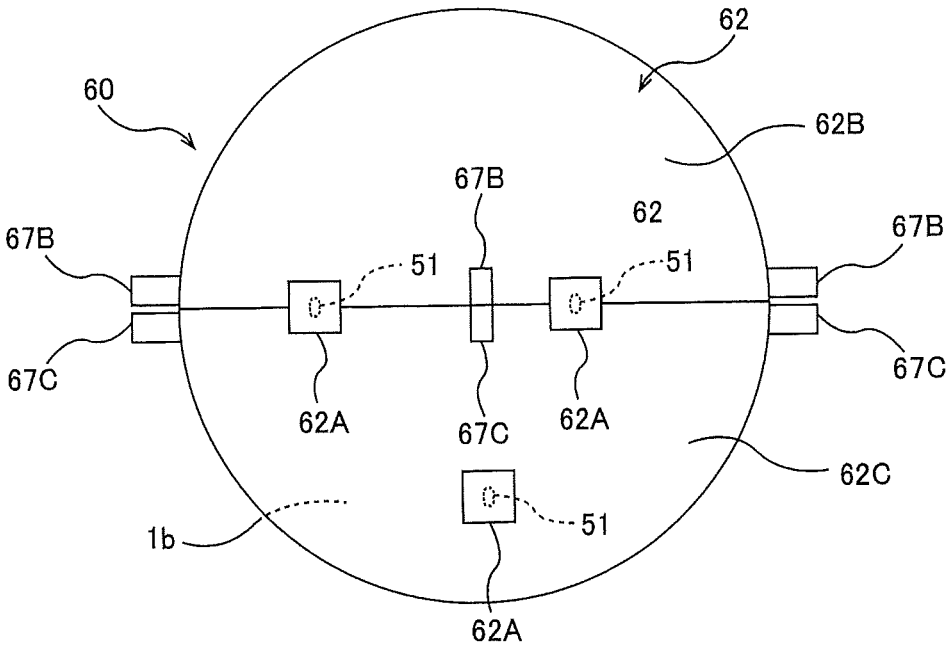
FIG. 43B is a backside view of the polishing-pad laminated structure shown in FIG. 43A.

FIG. 40A is a top view showing still another embodiment of a polishing-pad laminated structure 60 used for the polishing table 3 in which the two sensor heads 31 are arranged, and FIG. 40B is a backside view of the polishing-pad laminated structure 60 shown in FIG. 40A. Configurations, which are not particularly described, are the same as those of the embodiment described with reference to FIGS. 27A and 27B, and thus the description thereof will not be repeated. As shown in FIG. 40A, a polishing pad 1 has two through-holes 51 corresponding to the two sensor heads 31. The positions of these two through-holes 51 correspond to the positions of the two sensor heads 31 in the polishing table 3. As shown in FIG. 40B, a release sheet 62 is divided into two first release sheets 62A, a second release sheet 62B, and a third release sheet 62C.

The polishing-pad positioning instrument 80 shown in FIG. 30, the polishing-pad positioning instrument 80 shown in FIGS. 33A and 33B, and the polishing-pad positioning instrument 80 shown in FIGS. 34 and 35 can be used for attaching the polishing pad 1 shown in FIG. 39A and the polishing pad 1 shown in FIG. 40A to the pad support surface 3*b* of the polishing table 3.

The number and positions of the through-holes 51 of the polishing pad 1 are determined based on the number and positions of the sensor heads 31 disposed in the polishing table 3. The number and position of the sensor heads 31 are not limited to the embodiments described above. In one embodiment, three or more sensor heads 31 may be arranged. The same number of through-holes 51 of the polishing pad 1 is formed at the same positions of the sensor heads 31. For example, as shown in FIGS. 41A, 41B, 42A, 42B, 43A, and 43B, a polishing pad 1 may have three through-holes 51.

Figure 44:
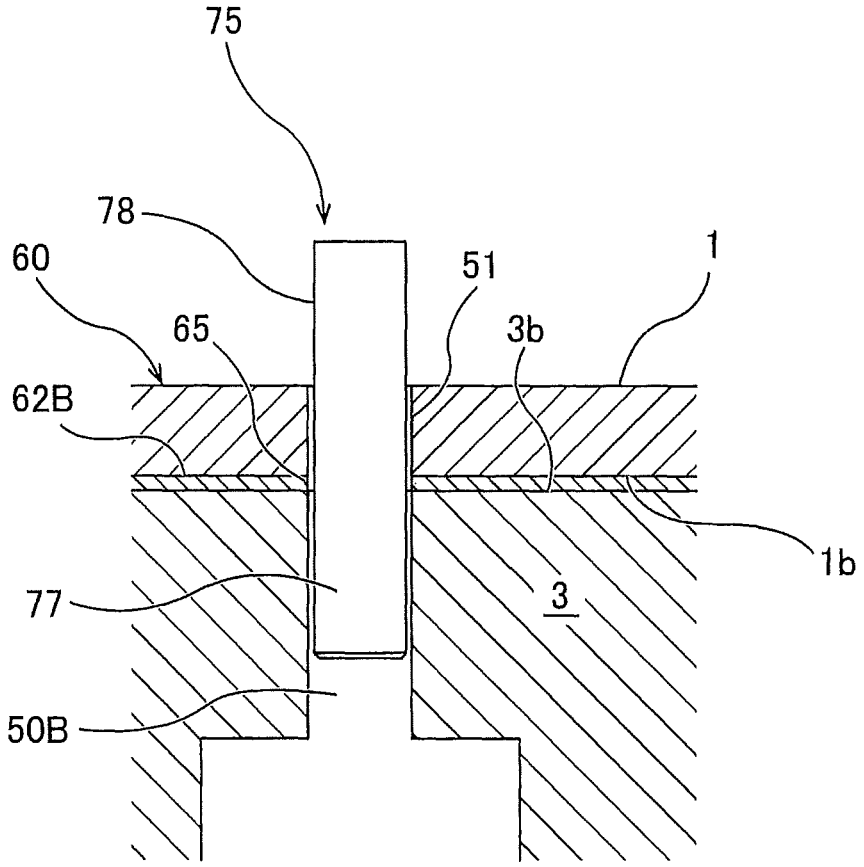
FIG. 44 is a view showing another embodiment of a positioning structure.

The shape of the positioning structure 75 is not limited to the embodiments described above. In particular, the shape and the size of the first positioning protrusion 77 are determined based on the table hole provided in the polishing table 3. For example, as shown in FIG. 44, the cross section of the first positioning protrusion 77 may have the same shape and the same size as those of the cross section of the second positioning protrusion 78. Furthermore, in one embodiment, the cross section of the first positioning protrusion 77 may be larger than the cross section of the second positioning protrusion 78.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing-pad laminated structure comprising:

a polishing pad having a through-hole located at a position corresponding to a position of a sensor head disposed in a polishing table; and a release sheet covering an adhesive surface of the polishing pad, the release sheet being divided into at least a first release sheet and a second release sheet, the first release sheet having a surface area smaller than a surface area of the second release sheet, the first release sheet being located outside the second release sheet.

2. The polishing-pad laminated structure according to claim 1, wherein the second release sheet has a through-hole at a same position as a position of the through-hole of the polishing pad.

3. The polishing-pad laminated structure according to claim 1, further comprising:

a release assisting projection connected to an edge of the second release sheet.

4. A polishing-pad positioning instrument for positioning a polishing pad with respect to a polishing table, comprising:

a positioning structure configured to be removably attached to the polishing table; and a support structure supporting the positioning structure, the positioning structure including (i) a first positioning protrusion configured to be inserted into a table hole formed in a pad support surface of the polishing table, (ii) a second positioning protrusion fixed to the first positioning protrusion, the second positioning protrusion having a cross-sectional shape corresponding to a cross-sectional shape of a through-hole formed in the polishing pad, and (iii) a third positioning protrusion connected to the second positioning protrusion, the third positioning protrusion having a mark indicating a position of the first positioning protrusion with respect to the central axis of the second positioning protrusion, the support structure supporting the third positioning protrusion, the support structure having at least two legs separated from each other, the first positioning protrusion and the second positioning protrusion being located between the at least two legs.

5. The polishing-pad positioning instrument according to claim 4, wherein a length of the second positioning protrusion along a central axis of the second positioning protrusion is not less than a thickness of the polishing pad.

6. A polishing-pad positioning instrument for positioning a polishing pad with respect to a polishing table, comprising:

a positioning structure configured to be removably attached to the polishing table; and a support structure supporting the positioning structure, the positioning structure including (i) a first positioning protrusion configured to be inserted into a table hole formed in a pad support surface of the polishing table, (ii) a second positioning protrusion fixed to the first positioning protrusion, the second positioning protrusion having a cross-sectional shape corresponding to a cross-sectional shape of a through-hole formed in the polishing pad, and (iii) a third positioning protrusion connected to the second positioning protrusion, the third positioning protrusion having a mark indicating a position of the first positioning protrusion with respect to the central axis of the second positioning protrusion, the support structure supporting the third positioning protrusion, wherein the support structure has at least two legs separated from each other, the support structure includes a stopper having an engagement portion configured to be inserted into a recessed portion of the third positioning protrusion, and a distance from bottom surfaces of the legs to a top surface of the engagement portion is longer than a distance from a tip end of the first positioning protrusion to an upper surface of the recessed portion.

7. A polishing-pad positioning instrument for positioning a polishing pad with respect to a polishing table, comprising:

a positioning structure configured to be removably attached to the polishing table; and a support structure supporting the positioning structure, the positioning structure including (i) a first positioning protrusion configured to be inserted into a table hole formed in a pad support surface of the polishing table, and (ii) a second positioning protrusion fixed to the first positioning protrusion, the second positioning protrusion having a cross-sectional shape corresponding to a cross-sectional shape of a through-hole formed in the polishing pad, the support structure supporting the second positioning protrusion, the support structure having a bottom surface perpendicular to a central axis of the second positioning protrusion.

8. The polishing-pad positioning instrument according to claim 7, wherein the second positioning protrusion is supported by the support structure such that the second positioning protrusion is movable along the central axis of the second positioning protrusion.

9. The polishing-pad positioning instrument according to claim 8, further comprising a spring disposed between the second positioning protrusion and the support structure, the positioning structure being forced by the spring in an extending direction of the central axis of the second positioning protrusion.

10. A method of attaching a polishing pad to a pad support surface of a polishing table, comprising:

(i) providing a polishing-pad laminated structure including the polishing pad and a release sheet, the polishing pad having a through-hole located at a position corresponding to a position of a sensor head disposed in the polishing table, the release sheet covering an adhesive surface of the polishing pad, the release sheet being divided into at least a first release sheet and a second release sheet, the first release sheet having a surface area smaller than a surface area of the second release sheet;

(ii) providing a positioning structure including a first positioning protrusion and a second positioning protrusion, the first positioning protrusion being configured to be inserted into a table hole formed in the pad support surface of the polishing table, the second positioning protrusion being fixed to the first positioning protrusion, the second positioning protrusion having a cross-sectional shape corresponding to a cross-sectional shape of the through-hole of the polishing pad;

(iii) placing the polishing-pad laminated structure, from which the first release sheet has been removed, on the pad support surface of the polishing table;

(iv) inserting the first positioning protrusion into the table hole through the through-hole of the polishing pad;

(v) inserting the second positioning protrusion into the through-hole of the polishing pad;

(vi) removing the positioning structure from the polishing table and the polishing pad; and (vii) removing the second release sheet from the polishing pad and attaching the entire adhesive surface of the polishing pad to the pad support surface of the polishing table.

11. A method of attaching a polishing pad to a pad support surface of a polishing table, comprising:

(i) providing a polishing-pad laminated structure including the polishing pad and a release sheet, the polishing pad having a through-hole located at a position corresponding to a position of a sensor head disposed in the polishing table, the release sheet covering an adhesive surface of the polishing pad, the release sheet being divided into at least a first release sheet and a second release sheet, the first release sheet having a surface area smaller than a surface area of the second release sheet;

(ii) providing a positioning structure including a first positioning protrusion and a second positioning protrusion, the first positioning protrusion being configured to be inserted into a table hole formed in the pad support surface of the polishing table, the second positioning protrusion being fixed to the first positioning protrusion, the second positioning protrusion having a cross-sectional shape corresponding to a cross-sectional shape of the through-hole of the polishing pad;

(iii) inserting the first positioning protrusion into the table hole;

(iv) placing the polishing-pad laminated structure, from which the first release sheet has been removed, on the pad support surface of the polishing table;

(v) inserting the second positioning protrusion into the through-hole of the polishing pad;

(vi) removing the positioning structure from the polishing table and the polishing pad; and (vii) removing the second release sheet from the polishing pad and attaching the entire adhesive surface of the polishing pad to the pad support surface of the polishing table.

* * * * *